US005832328A

United States Patent [19]

Ueda

[11] Patent Number: 5,832,328

[45] Date of Patent: Nov. 3, 1998

[54] AUTOMATIC PROCESSING MACHINE FOR A SILVER HALIDE PHOTOGRAHIC LIGHT-SENSITIVE MATERIAL

[75] Inventor: Yutaka Ueda, Hino, Japan

[73] Assignee: Konica Corporation, Tokyo, Japan

[21] Appl. No.: 645,249

[22] Filed: May 13, 1996

[30] Foreign Application Priority Data

May 19, 1995 [JP] Japan ..... 7-121274

[51] Int. Cl.[6] ..... G03D 13/00; G03D 3/02

[52] U.S. Cl. ..... 396/572; 396/627

[58] Field of Search ..... 396/622, 624, 396/627, 571, 579, 572

[56] References Cited

U.S. PATENT DOCUMENTS

| | | | |
|---|---|---|---|
| 3,405,627 | 10/1968 | Day et al. | 134/122 P |
| 3,610,131 | 10/1971 | Frick et al. | 134/122 P |
| 4,327,987 | 5/1982 | Friar et al. | 396/604 |
| 4,800,275 | 1/1989 | Shimizu et al. | 355/27 |
| 4,841,320 | 6/1989 | Takekoshi et al. | 396/575 |
| 4,884,093 | 11/1989 | Bohmig | 396/571 |
| 5,089,839 | 2/1992 | Nakano et al. | 396/617 |
| 5,114,836 | 5/1992 | Sato et al. | 430/434 |
| 5,148,206 | 9/1992 | Shidara | 396/622 |
| 5,307,109 | 4/1994 | Miyasaka et al. | 396/571 |

*Primary Examiner*—D. Rutledge
*Attorney, Agent, or Firm*—Frishauf, Holtz, Goodman, Langer & Chick, P.C.

[57] ABSTRACT

An apparatus for processing a silver halide photographic light-sensitive material having an emulsion surface includes a heater for heating the light sensitive material and a supplier having a supplying section positioned so as to form air space between the supplying section and the emulsion surface of the light-sensitive material so that the supplier supplies a processing solution from the supplying section through the air space onto the emulsion surface of the conveyed light-sensitive material.

13 Claims, 10 Drawing Sheets

AUTOMATIC PROCESSING MACHINE FOR A SILVER HALIDE PHOTOGRAHIC LIGHT-SENSITIVE MATERIAL

BACKGROUND OF THE INVENTION

The present invention relates to an automatic processing machine (hereinafter, it may also be referred to as "an automatic machine") for a silver halide photographic light-sensitive material which processes the silver halide photographic light-sensitive material (hereinafter, it may simply be referred to as a light-sensitive material) by the use of a processing solution.

Recently, concern for environmental regulation has become common. In the photographic industry too, it is a critical theme to attain reduction of photographic processing effluent.

In addition, recently, due to the proliferation of mini-lab shops, processing amount of the light-sensitive material per one unit of mini-lab is reduced. Therefore, the daily solution renewal ratio of processing solutions in the processing tanks has come to be reduced. Accordingly, the processing solutions become deteriorated so that stable processing performance is difficult to be kept. Specifically, in the case of a color developing solution, due to air oxidation, the processing solution deteriorates remarkably so that it is difficult to maintain stable processing performance.

In addition, Japanese Patent Publication Open to Public Inspection (hereinafter, referred to as Japanese Patent O.P.I. Publication) No. 324455/1994 discloses a technology of feeding a processing solution from a processing solution container which houses tightly aforesaid processing solution which processes the silver halide photographic light-sensitive material onto the emulsion surface of the silver halide photographic light-sensitive material through a gas phase.

It was found that, due to the technology disclosed in Japanese Patent O.P.I. Publication No. 324455/1994 wherein the processing solution which processes the silver halide photographic light-sensitive material is fed onto the emulsion surface of the silver halide photographic light-sensitive material through a gas phase, solution renewal ratio of the processing solution can be raised and that the photographic processing effluent can be reduced.

However, Japanese Patent O.P.I. Publication No. 324455/1994 does not disclose a means for promoting the reaction of the processing solution. However, according to a method described in Japanese Patent O.P.I. Publication No. 324455/1994, an ordinary silver halide photographic light-sensitive material is hardened before the processing solution is fed. Accordingly, it was discovered that the permeability of the processing solution is low and that processing progression (specifically, photographic processing progression) is also reduced accordingly. Specifically, in the case of color developing processing, as the progression of silver development, halogenated products are dissolved from silver halide crystals. The smaller the processing solution amount fed to the light-sensitive material is, the higher the density of the halogenated product dissolved becomes. As a result, development is caused to be inhibited and development progression is further reduced.

A first object of the present invention is to prevent reduction of the speed of the processing progression by feeding the processing solution which processes the silver halide photographic light-sensitive material onto the emulsion surface of the silver halide photographic light-sensitive material through a gas phase.

In addition, Japanese Patent O.P.I. Publication No. 324455/1994 describes that a processing agent component is replenished by replacing the container of the processing solution. However, in the case of this method, replacement must be conducted frequently if the container of the processing solution is small. When the container of the processing solution is large, handling ease suffers and replacement becomes troublesome.

In addition, according to a method described in Japanese Patent O.P.I. Publication No. 324455/1994, even when the processing solution is tightly closed in a container, the solution surface is reduced as the processing solution is used up so that the interface area of the processing solution and air increases, while the volume of the processing solution in the processing solution container is reduced. Accordingly, the interface area with air per unit volume of the processing solution increases, and thereby deterioration of the processing solution rapidly progresses.

A second object of the present invention is to simplify replenishment of the processing agent component by supplying a solid processing agent and replenisher water into the processing solution container which houses the processing solution for processing the silver halide photographic light-sensitive material. In addition, by supplying a solid processing agent and replenisher water into the processing solution container which houses the processing solution processing the silver halide photographic light-sensitive material, the volume of the processing solution inside the processing solution container and the solution level of the processing solution can be kept in a prescribed range so that rapid deterioration of the processing solution can be prevented.

Other objects of the present invention will be apparent in the following specification.

SUMMARY OF THE INVENTION

In order to attain the above-mentioned objects, the present inventors laboriously studied the problems. As a result, it was discovered that the above-mentioned problems can be overcome by constitutions explained below.

Due to an automatic processing machine for silver halide photographic light-sensitive material having a processing solution feeding means which feeds the processing solution which processes the silver halide photographic light-sensitive material onto the emulsion surface of the silver halide photographic light-sensitive material through a gas phase (air space) and a heating means which heats the silver halide photographic light-sensitive material to which the processing solution is fed by means of the above-mentioned processing solution feeding means, processing solution whose amount is only necessary to process the light-sensitive material may be fed by feeding the processing solution which processes the silver halide photographic light-sensitive material onto the emulsion surface of the silver halide photographic light-sensitive material through a gas phase. Therefore, reduction of processing progression can be prevented by heating the silver halide photographic light-sensitive material to which the processing solution is fed by means of the above-mentioned processing solution feeding means, while the amount of the photographic processing effluent can be reduced.

By heating the silver halide photographic light-sensitive material, reduction of the processing progression can be prevented. When heating the processing tank which houses the processing solution, it is ordinarily difficult to heat the processing tank from the viewpoint of the storage stability of the processing solution. Compared to this, the present invention can heat to higher temperature. In such occasions, processing progression can be increased without worrying about the storage stability of the processing solution.

Due to a structure in which the above-mentioned processing solution feeding means feeds the processing solution which processes the silver halide photographic light-sensitive material, heated by means of the above-mentioned heating means, onto the emulsion surface of the silver halide photographic light-sensitive material through a gas phase, the light-sensitive material is heated before the processing solution is fed. Therefore, since the degree of the activity of the processing solution is high from the instant when the processing solution is fed to the light-sensitive material, the processing progression due to the processing solution is further increased.

Due to a structure in which the above-mentioned processing solution feeding means feeds the processing solution which processes the silver halide photographic light-sensitive material, being (while) heated by means of the above-mentioned heating means, onto the emulsion surface of the silver halide photographic light-sensitive material through a gas phase, the light-sensitive material is heated when the processing solution is fed. Therefore, while processing progression is being increased, temperature may (or may not) be controlled.

Due to a structure in which the above-mentioned heating means heats the silver halide photographic light-sensitive material to which the processing solution is fed, by means of the above-mentioned processing solution feeding means, onto the emulsion surface of aforesaid silver halide photographic light-sensitive material through a gas phase, the processing solution heats the light-sensitive material after the processing solution is fed. Therefore, the light-sensitive material and the processing solution are concurrently heated so that the temperature during the processing reaction may (or may not) be controlled. In addition, when the processing solution is fed onto the light-sensitive material, if there is no major difference between the temperature of the light-sensitive material and that of the processing solution such as that neither the light-sensitive material nor the processing solution are heated, a problem caused by the sudden contact of the light-sensitive material and the processing solution whose temperatures are quite different from each other can be prevented.

Due to having a processing solution container which houses a processing solution processing the silver halide photographic light-sensitive material and feeding aforesaid processing solution from the aforesaid processing solution container by means of the above-mentioned processing solution feeding means, the processing solution which was housed in the processing solution container is fed to the light-sensitive material. Therefore, by feeding the processing solution which processes the silver halide photographic light-sensitive material onto the emulsion surface of the silver halide photographic light-sensitive material through a gas phase, the amount of the processing solution inside the processing solution container can be decreased compared to cases where the light-sensitive material is immersed in the processing tank which houses the processing solution. Accordingly, the solution renewal ratio of the processing solution can be increased. In addition, since the amount of the processing solution only necessary to process the light-sensitive material may be fed, reduction of the processing progression can be prevented by heating the silver halide photographic light-sensitive material to which the processing solution is fed by means of the processing solution feeding means, while the amount of the photographic processing effluent can be reduced.

In addition, since the silver halide photographic light-sensitive material is heated, it is not necessary to heat the processing solution container for preventing the reduction of the processing progression. Therefore, it is not necessary to heat the processing solution container. Accordingly, deterioration of the processing solution housed in the processing solution container due to heat can be prevented.

Due to an automatic processing machine for silver halide photographic light-sensitive material having a processing solution feeding means which feeds the processing solution which processes the silver halide photographic light-sensitive material onto the emulsion surface of the silver halide photographic light-sensitive material through a gas phase and a heating means which heats the silver halide photographic light-sensitive material to which the processing solution is fed by means of the above-mentioned processing solution feeding means, the processing solution whose amount is only necessary to process the light-sensitive material may be fed by feeding the processing solution which processes the silver halide photographic light-sensitive material onto the emulsion surface of the silver halide photographic light-sensitive material through a gas phase. Therefore, reduction of the processing progression can be prevented by heating the processing solution which is fed by means of the above-mentioned processing solution feeding means, while the amount of the photographic processing effluent can be reduced.

Due to having a processing solution container which houses a processing solution processing the silver halide photographic light-sensitive material, feeding aforesaid processing solution from the aforesaid processing solution container by means of the above-mentioned processing solution feeding means, and having a heating means which heats the processing solution fed from the processing solution container to the above-mentioned processing solution feeding means, the processing solution fed from the processing solution container to the above-mentioned processing solution feeding means is heated so that the reduction of processing progression is prevented. When the processing tank which houses the processing solution is heated, it is difficult to heat the processing solution ordinarily to 45° C. or higher due to the storage stability of the processing solution. However, in the present invention, it is possible to heat the processing solution higher than the above-mentioned temperature. In such an occasion, it is possible to increase the processing progression, without worrying about the storage stability of the processing solution. In addition, it is not necessary to heat the processing solution container for preventing the reduction of processing progression, deterioration of the processing solution housed in the processing solution container due to heat can be prevented.

Due to heating the processing solution by mean of the above-mentioned heating means in the above-mentioned processing solution feeding means, the processing solution is heated in the above-mentioned processing solution feeding means so that the reduction of processing progression can be prevented. When the processing tank which houses the processing solution is heated, it is difficult to heat the processing solution ordinarily to 45° C. or higher due to the storage stability of the processing solution. However, in the present invention, it is possible to heat the processing solution higher than the above-mentioned temperature. In such an occasion, it is possible to increase the processing progression, without worrying about the storage stability of the processing solution.

Due to having a processing solution container which houses a processing solution processing the silver halide photographic light-sensitive material, and feeding aforesaid processing solution from the aforesaid processing solution container by means of the above-mentioned processing solution feeding means, it is not necessary to heat the processing solution container for preventing the reduction of processing progression. Therefore, deterioration of the processing solution housed in the processing solution container due to heat can be prevented.

Due to a solid processing agent supplying means which supplies the solid processing agent for the silver halide photographic light-sensitive material in the above-mentioned processing solution container and a replenishing water feeding means which feeds the replenishing water in the above-mentioned processing solution container, replenishment can be conducted by supplying the solid processing agent and the replenishing water to the processing solution container which houses the processing solution processing the silver halide photographic light-sensitive material. Therefore, replenishment can be conducted more simply and more easily compared to a case when replacing the processing solution container. In addition, by supplying the solid processing agent and the replenishing water to the processing solution container which houses the processing solution processing the silver halide photographic light-sensitive material, the volume of the processing solution and the solution surface level of the processing solution can be included in a prescribed range. In such occasions, deterioration of the processing solution housed in the processing solution container can be prevented.

Due to an automatic processing machine for silver halide photographic light-sensitive material having a processing solution container which houses a processing solution processing the silver halide photographic light-sensitive material, a processing solution feeding means which feeds aforesaid processing solution from the above-mentioned processing solution container onto the emulsion surface of the silver halide photographic light-sensitive material through a gas phase, a solid processing agent supplying means which supplies the solid processing agent for the silver halide photographic light-sensitive material in the above-mentioned processing solution container and a replenishing water feeding mean which feeds the replenishing water in the above-mentioned processing solution container, replenishment can be conducted by supplying the solid processing agent and the replenishing water to the processing solution container which houses the processing solution processing the silver halide photographic light-sensitive material. Therefore, replenishment can be conducted more simply and more easily compared to a case when replacing the processing solution container. In addition, by supplying the solid processing agent and the replenishing water to the processing solution container which houses the processing solution processing the silver halide photographic light-sensitive material, the volume of the processing solution and the solution surface level of the processing solution can be kept within a prescribed range. In such occasions, rapid deterioration of the processing solution housed in the processing solution container can be prevented.

Due to having a filtration means which is provided between the above-mentioned processing solution container and the above-mentioned processing solution feeding means and which filtrates the processing solution from the above-mentioned processing solution container, insoluble residues such as dust in the processing solution can be removed, and the occurrence of uneven processing, due to the clogging of the insoluble residues and supply of aforesaid clogging of the insoluble residues to the light-sensitive material, can be prevented. In addition, the corrosion of the processing solution feeding means due to the fact that the insoluble residues in the solid processing agent is clogged in the processing solution feeding means, rapidly deterioration of the processing solution inside the processing solution feeding means due to the fact that the density of the processing agent component inside the processing solution feeding means becomes abnormally increased when the feeding of the processing solution from the processing feeding means stops and the occurrence of discoloration and uneven processing due to the fact that the deteriorated processing solution is supplied to the light-sensitive material can be prevented.

Due to having a stirring means which stirs the processing solution in the above-mentioned processing solution container, non-uniformity of the processing agent component and that of the density of the processing agent components can be prevented. In addition, dissolution of the solid processing agent is accelerated so that no problem occurs even when the processing amount of the light-sensitive material is large compared to the volume of the processing solution container. In addition, the above-mentioned filtration means can prevent splashing of undissolved solid processing agent in the processing solution to be stirred by the stirring means, and thereby, dissolution of the solid processing agent can be further accelerated.

Due to having a circulation means which circulates the processing solution in the above-mentioned processing solution container, non-uniformity of the processing agent component and that of the density of the processing agent component can be prevented. In addition, dissolution of the solid processing agent is accelerated so that no problem occurs even when the processing amount of the light-sensitive material is large compared to the volume of the processing solution container. In addition, the above-mentioned circulation means can prevent splashing of undissolved solid processing agent in the processing solution to be circulated by the stirring means, and thereby, dissolution of the solid processing agent can be further accelerated.

Due to having a circulation and filtration means-which filtrates the processing solution on the downstream side of the region where the solid processing agent is supplied by means of the above-mentioned solid processing agent supplying means and on the upstream side of the region where the processing solution fed by the above-mentioned processing solution feeding means exists in a circulation path of the processing solution which circulates by means of the above-mentioned circulation means, insoluble residues such as dust in the processing solution can be removed, and the occurrence of uneven processing, due to the clogging of the insoluble residues and supply of aforesaid clogging of the insoluble residues to the light-sensitive material, can be prevented. In addition, the corrosion of the processing solution feeding means due to the fact that the insoluble residues in the solid processing agent is clogged in the processing solution feeding means, rapidly deterioration of the processing solution inside the processing solution feeding means due to the fact that the density of the processing agent component inside the processing solution feeding means becomes abnormally increased when the feeding of the processing solution from the processing feeding means stops and the occurrence of discoloration and uneven processing due to the fact that the deteriorated processing solution is supplied to the light-sensitive material can be prevented.

Due to a structure in which the above-mentioned processing solution container is tightly closed, entry of fresh air into the processing solution in the processing solution container and deterioration of the processing solution due to the fresh air can be prevented. In addition, offensive odors and nausa due to it caused by the escape of gas which occurred due to the deterioration of the processing solution inside the processing solution container can be prevented.

Due to a structure in which the amount of the processing solution fed from the above-mentioned processing solution feeding means onto the emulsion surface of the silver halide photographic light-sensitive material through the gas phase is 20 ml or more and 200 ml or less per 1 $m^2$ of the silver halide photographic light-sensitive material, sufficient amount of the processing solution is fed to the light-sensitive material. Therefore, concurrently with that sufficient processability is resulted in, an excessive amount of the processing solution is not fed onto the light-sensitive material. Accordingly, overflow and dribbling of the fed processing solution from the emulsion surface of the light-sensitive material can easily be prevented.

Due to a structure that the above-mentioned processing solution is either a developing solution or a bleaching solution, the processing solution is either a developing solution or a bleaching solution. Therefore, since there is no processing step to remove silver ion and unnecessary materials from the light-sensitive material, it is easy to sufficiently process the light-sensitive material.

Due to a structure in which the above-mentioned processing solution is a color developing solution, the processing solution is easily deteriorated due to air when the processing solution is a color developing solution. Therefore, effects to prevent the deterioration of the above-mentioned processing solution are more noticeable.

Due to feeding a processing solution onto the emulsion surface of the silver halide photographic light-sensitive material through the gas phase from a feeding port of the above-mentioned processing solution feeding means and having a feeding port drying preventing means for preventing drying of the processing solution located at the above-mentioned feeding port, drying of the processing solution at the feeding port is prevented. Therefore, uneven processing of the light-sensitive material which was processed by the processing solution located at the feeding port due to an increase of the density of the processing solution located at the feeding port by drying of the processing solution at the feeding port, deterioration of the processing solution located at the feeding port and clogging of the feeding port can be prevented.

Due to a structure that the above-mentioned feeding port drying preventing means covers the above-mentioned feeding port, drying of the processing solution at the feeding port can be prevented with a simple mechanism, without providing an expensive mechanism such as a humidifier.

Due to having a control means which controls in a manner that the above-mentioned processing solution feeding means feeds the processing solution only when the silver halide photographic light-sensitive material exists before the above-mentioned processing solution feeding means feeds the processing solution, the processing solution can be fed only when necessary. Therefore, unnecessary feeding of the processing solution can be prevented.

Due to having a conveyance means which conveys the above-mentioned silver halide photographic light-sensitive material at a prescribed conveyance speed and having a light-sensitive material sensing means which senses the existence of the above-mentioned silver halide photographic light-sensitive material at a prescribed position on the upstream side, in the conveyance direction, of the above-mentioned conveyance means from a point where the above-mentioned processing solution feeding means feeds the processing solution, wherein the above-mentioned control means controls the processing solution based on sensing by means of the above-mentioned light-sensitive material sensing means, with a simple apparatus, control, in which the above-mentioned processing solution feeding means feeds the processing solution only when the silver halide photographic light-sensitive material exists before the processing solution feeding means feeds the processing solution, can be conducted. Due to this, the processing solution can be fed only when necessary. Therefore, wasted supply of the processing solution can be prevented. In addition, contamination of associated devices due to wasted supply of the processing solution can be prevented.

Due to a structure in which the above-mentioned control means controls the processing solution in such a manner that the above-mentioned processing solution feeding means starts feeding the processing solution only after passage of a prescribed time since the above-mentioned light-sensitive material sensing means sensed existence of the silver halide photographic light-sensitive material at the above-mentioned prescribed position from non-existence and that the above-mentioned processing solution feeding means stops feeding the processing solution only after passage of a prescribed time since the above-mentioned light-sensitive material sensing means sensed non-existence of the silver halide photographic light-sensitive material at the above-mentioned prescribed position from existence, with a simple apparatus, control in which the above-mentioned processing solution feeding means feeds the processing solution only when the silver halide photographic light-sensitive material exists before the processing solution feeding means feeds the processing solution can be conducted. Due to this, the processing solution can be fed only when necessary. Therefore, wasted supply of the processing solution can be prevented. In addition, contamination of associated devices due to wasted supply of the processing solution can be prevented.

Due to a structure in which the above-mentioned light-sensitive material sensing means also senses the width of the silver halide photographic light-sensitive material at the above-mentioned prescribed position, the above-mentioned processing solution feeding means can modify the width of the fed processing solution and the above-mentioned control means controls to modify the width of the fed processing solution in accordance with the width of the sensed silver halide photographic light-sensitive material by means of the above-mentioned processing solution feeding means, the processing solution can be fed for necessary width in accordance with the width of the light-sensitive material. Therefore, wasted supply of the processing solution can be prevented. In addition, contamination of associated devices due to wasted supply of the processing solution can be prevented.

Due to a structure in which the above-mentioned control means controls to feed the processing solution only periodically even in a stand-by state wherein the silver halide photographic light-sensitive material is not processed, clogging due to drying of the processing solution in the processing solution feeding means can be prevented. In addition, uneven processing and discoloration on a processed light-sensitive material by the deterioration of processing solution in the processing solution feeding means can be prevented.

DETAILED DESCRIPTION OF THE PREFERRED EMBODIMENT

[Silver halide photographic light-sensitive material]

Figure 1:
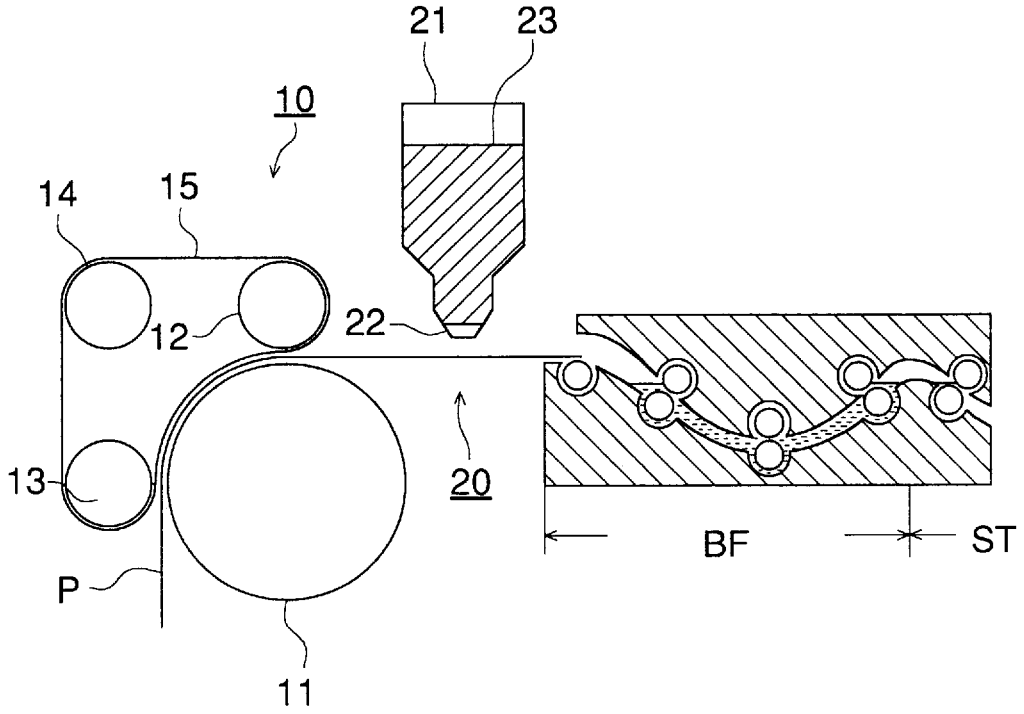
FIG. 1 is a schematic diagram of the main portion of an automatic processing machine of Example 1.

Examples of the light-sensitive material used in the present invention include a silver halide color photographic light-sensitive material containing a silver chloride emulsion and a silver halide color photographic light-sensitive material containing a silver bromoiodide emulsion or a silver bromide emulsion.

[Processing solution feeding means]

The processing solution feeding means includes a processing solution splashing means which splashes the processing solution onto the light-sensitive material through a gas phase and a processing solution coating means, such as a curtain coater, which coats the processing solution onto the light-sensitive material through a gas phase. In the present invention, the expression "to supply a processing solution through gas phase" means that the feeding section supplies the processing solution through air space to an emulsion surface of the light-sensitive material to be processed without contacting the emulsion surface. More concretely, the processing solution splashing means which splashes the processing solution onto the light-sensitive material through gas phase includes those which splash actively by generating pressure by means of a splashing means after processing the light-sensitive material by feeding the processing solution through a gas phase, such as those having a similar structure to the ink jet head unit of an ink jet printer and those having a structure described in Japanese Patent O.P.I. Publication No. 324455/1994 and a spray bar wherein the processing solution is splashed due to liquid pressure given to the splashing means after processing a light-sensitive material by feeding the processing solution through has phase. The processing solution splashing means which splashes the processing solution onto the light-sensitive material through a gas phase by the use of a similar structure as the ink jet head unit of an ink jet printer includes those feeding the processing solution due to vibration and those feeding the processing solution by means of sudden boiling. These methods are preferable because they can control the feeding amount of the processing solution and they can select the processing position of the light-sensitive material.

Any methods can be used for the processing solution feeding means, such as those which feed the processing solution onto the light-sensitive material from the feeding head through a gas phase, those which feed the processing solution onto the light-sensitive material from a plain-shaped feeding head through a gas phase and those which feed the processing solution onto the light-sensitive material from a point-shaped feeding head through a gas phase may be used. When the light-sensitive material is a sheet type, the processing solution may be fed onto the light-sensitive material from the feeding head through a gas phase by the use of a plain-shaped feeding head corresponding to the size of the light-sensitive material, while the position relationship between the light-sensitive material and the feeding head is fixed. However, it is preferable that the processing solution is fed onto the light-sensitive material from the feeding head through a gas phase, under a moving relationship between the feeding head and the light-sensitive material, because, with this method, sufficient processing solution can be fed onto the light-sensitive material even when the feeding head is small. In addition, when a bar-shaped feeding head is used, the feeding head may be mobile. However, in order to feed the processing solution onto the light-sensitive material quickly, it is preferable to move the light-sensitive material in a direction not parallel to the bar-shaped feeding head. Specifically, in order to set a processing time constant, it is preferable to move the light-sensitive material in a direction perpendicular to the bar-shaped feeding head. In addition, as the processing solution splashing means, when the processing solution is fed onto the light-sensitive material from the feeding head through gas phase, under a moving relationship between the feeding head and the light-sensitive material, the number of splashing the processing solution onto the light-sensitive material from the feeding head through a gas phase per second by the processing solution splashing means is preferably once or more and specifically preferably 10 or more times, in order to feed the processing solution sufficiently on the surface of the light-sensitive material. In addition, for splashing the processing solution from the feeding head, $1\times10^{6}$ times or less is preferable, and $1\times10^{5}$ times or less is more preferable.

When the processing solution is fed onto the light-sensitive material through the feeding port by means of the processing solution feeding means, the form of the feeding port may be any, such as circular, rectangular and elliptical. In addition, the area of each feeding port is preferably $1\times10^{-11}$ $m^2$ or more and specifically preferably $1\times10^{-10}$ $m^2$ or more, in order to prevent clogging even when the processing solution is slightly dried. In addition, in order to feed the processing solution uniformly onto the light-sensitive material, the area of each feeding port is preferably $1\times10^{-8}$ $m^2$ or less and specifically preferably $1\times10^{-6}$ $m^2$ or less. In addition, interval of distance between feeding ports should be $5\times10^{-6}$ m or more in terms of an average of the distance between the edge of one feeding port and the edge of the adjacent feeding port from a viewpoint of the strength of the feeding port, and $1\times10^{-3}$ m or less in order to sufficiently feed the processing solution onto the surface of the light-sensitive material.

The distance between the feeding port and the emulsion surface on the light-sensitive material is preferable 50 $\mu$m or more (and specifically 1 mm or more) and 10 mm or less (specifically 5 mm or less) in terms of simplified control.

[Heating means]

The temperature of the light-sensitive material heated by the heating means is allowed to be 40° C. or less. However, it is preferably 40° C. or more, specifically 45° C. or more and more specifically 50° C. or more. However, in terms of heat-resistance of the light-sensitive material and control ease of processing, it is preferably 100° C. or less and, in order to prevent boiling of the processing solution, more preferably 90° C. or less and most preferably 80° C. or less.

A heating means which heats the light-sensitive material includes transmission heating means, such as a heating drum and a heating belt, which heats the light-sensitive material due to transmission by contacting the light-sensitive material, convection heating means, such as a drier, due to convection and emission heating means due to emission of infrared beams or high frequency electromagnetic waves.

In the case of a heating means which heats while contacting, it preferable for a heat source to contact with a back surface side of a light-sensitive material to be processed in order to avoid an adverse effect for an emulsion surface of the light-sensitive material.

In the present invention, in the case that a light-sensitive material is heated before the processing solution is fed to an emulsion surface of the light-sensitive material, it is preferable to heat the light-sensitive material after the exposure for the light-sensitive material has been completed.

It is preferable that the automatic processing machine has a heating and controlling means which controls in a manner that the above-mentioned heating means heats when the silver halide photographic light-sensitive material exists ahead of the heating means heats because unnecessary heating can be prevented. The automatic processing machine can be attained by having a conveyance means which conveys the silver halide photographic light-sensitive material at a prescribed conveyance speed and also by having a light-sensitive material sensing means which senses the existence of the above-mentioned silver halide photographic light-sensitive material located at the prescribed position on the upstream side from a point where the heating means heats the silver halide photographic light-sensitive material, in the conveyance direction, in the above-mentioned conveyance means wherein the above-mentioned heating and controlling means controls the heating means based on sensing of the above-mentioned light-sensitive material sensing means. In such occasions, it is preferable that the above-mentioned control means controls the processing solution in a manner that the above-mentioned processing solution feeding means starts feeding the processing solution only after passage of a prescribed time since the above-mentioned light-sensitive material sensing means sensed existence of the silver halide photographic light-sensitive material from non-existence at the above-mentioned prescribed position and that the above-mentioned processing solution feeding means finishes feeding the processing solution after passage of a prescribed time since the above-mentioned light-sensitive material sensing means sensed non-existence of the silver halide photographic light-sensitive material from existence at the above-mentioned prescribed position.

[Stirring means]

A stirring means includes a propeller which is provided on a rotating shaft rotating due to a rotator or a motor which rotates by means of an induced magnetic field.

[Circulation means]

A circulation means may be a circulation pump which is used for a conventional automatic processing machine.

The silver halide photographic light-sensitive material comprises a support provided thereon with a silver halide emulsion layer. It may be provided on one side of the support, or may also be on both sides. The emulsion surface of the silver halide photographic light-sensitive material is a surface on which a silver halide emulsion layer is provided. The silver halide emulsion layer may be provided on both sides, on one side or on the other side.

[Solid processing agent supplying means]

As a solid processing agent supplying means which supplies the solid processing agent to the processing solution container, conventional methods such as those described in Japanese Utility Publication Open to Public Inspection Nos. 137783/1988, 97522/1988 and 85732/1989 are cited. However, any means which supplies a tablet to the processing solution container may be used. When the solid processing agent is granules or powder, a gravity falling type means as described in Japanese Utility Publication Open to Public Inspection Nos. 81964/1987 and 84151/1988 and Japanese Patent O.P.I. Publication No. 292375/1989 and methods by the use of a screw as described in Japanese Utility Publication Open to Public Inspection Nos. 105159/1988 and 195345/1988 are also cited. However, the present invention is not limited thereto.

It is preferable that the amount of the solid processing agent supplied at one time is 0.1 g or more from a viewpoint of durability and the accuracy of charging amount at one time of the solid processing agent supplying means. On the other hand, from a viewpoint of dissolution time, 50 g or less is preferable.

[Replenisher water]

Replenisher water is a solution, fed to the processing solution container, having an effect to dissolve the solid processing agent. Ordinarily, it is water.

[Solid processing agent]

A solid processing agent is the solid type processing agent containing the processing agent components of the processing solution which processes the light-sensitive material. The solid processing agent includes powder, tablet, pill and granule. In addition, those laminated with a water-soluble lamination such as a water soluble polymer on its surface as necessary may also be used. Powder in the present invention is an aggregate of fine grain crystals. Granule in the present invention is a granulated product of powder. It is preferably a granulated product whose grain size is 50 through 500 $\mu$m. In the present invention, a tablet is a material wherein powder or granules is compressed and molded into a certain shape. In the present invention, a pill is a rounded molded material (including a potato form and a spherical form) due to granulating or tableting. Of the above-mentioned solid processing agent, granules, tablets or pills are preferable because, when handling, the occurrence of dust is minimized and supplying accuracy is favorable. Of these three types, the tablet type is specifically preferable since replenishing accuracy is high, handling is easy and abrupt change of density due to abrupt dissolution does not occur and thereby the effects of the present inventions are provided more favorably.

In order to solidify a photographic processing agent, arbitrary means such as that the photographic processing agent in the form of a condensed solution, fine powder or granule or a water-soluble binder is kneaded for molding or that a laminated layer is formed by spraying a water-soluble binder on the surface of the photographic processing agent temporarily molded may be adopted. (See Japanese Patent O.P.I. Publication Nos. 29136/1992, 85533/1992 through 85536/1992 and 172341/1992)

The preferable manufacturing method of the tablet is a method wherein tableting processing is conducted after powdered solid processing agent is granulated. Compared to solid processing agent wherein solid processing agent components are simply mixed and the tablet is formed by the use of the tableting process, the above-mentioned method has merits in that it improves dissolubility and storage stability and thereby photographic performance becomes stable. As a granulating method for forming a tablet, granules or pills, conventional methods such rotation granulating methods, extrusion granulating methods, crushing granulating methods, stirring granulating methods, fluid bed layer granulating methods or spray drying granulating methods can be used. In addition, when granulating, it is preferable that a water-soluble binder is added at 0.01 through 20 weight % when granulating. Water-soluble binders preferably include celluloses, dextrins, saccharide alcohols, polyethylene glycols and cyclodextrins.

Hereunder, preferable compounds are listed. However, the present invention is not limited thereto.

I. Water-soluble polymers

Polyethylene glycol, polyvinyl alcohol, polyvinyl pyrrolidone, polyvinyl acetal, polyvinyl acetate, aminoalkyl methacrylate copolymer, methacrylic acid—methacrylic acid ester copolymer, methacrylic acid—acrylic acid ester copolymer and methacrylic acid type betaine type polymer.

II. Saccharides

Monosaccharides such as glycose and galactose, disaccharides such as maltose, sactose and ractose, saccharide alcohols such as mannitol, solbitol and erisritol, plurane, methyl cellulose, ethyl cellulose, hydroxypropyl cellulose, hydroxypropylmethyl cellulose, acetic acid phthalic acid cellulose, hydroxypropylmethyl cellulose phthalate, hydroxypropylmethyl cellulose acetate succinate, carboxymethylethyl cellulose, and dextrins starch-decomposed products.

Of the above-mentioned products, specifically preferable compounds are the block polymer (a pluronic type polymer) of polypropylene glycol and polyethylene glycol, polyethylene glycol (having an average molecular weight by weight of 2,000 through 20,000), methacrylic acid—methacrylic acid ester copolymer and methacrylic acid—acrylic ester copolymer of which Oidragit produced by Lame Ferma Inc., is a typical one, erisritol, ,altose, mannitol, dextrins and starch decomposed products of which Pine Flow or Pinedex produced by Matsutani Chemical is a typical one and methacrylic acid type betaine type polymer of which Yuka Former produced by Mitsubishi Yuka is a typical one.

The above-mentioned components are preferably 0.5% or more and 20% or less, and specifically preferably 0.5% or more and 20% or less against the weight of the solid processing agent.

Next, when a tablet is formed by compressing a granulated product, conventional compressors such as oil-pressure type pressurer, single tableting machines, rotary tableting machines and a pricketing machines can be used. In addition, it is preferable, when granulating, each component, such as an alkaline agent and a preserver, is granulated separately.

Tablet processing agents can be manufactured by any of ordinary methods such as those described in Japanese Patent O.P.I. Publication Nos. 61837/1976, 155038/1979 and 88025/1977 and British Patent No. 1,213,808. In addition, granule processing agents can be manufactured by any of ordinary methods such as those described in Japanese Patent O.P.I. Publication Nos. 109042/1990, 109043/1990, 39735/1991 and 29739/1991. In addition, powder processing agents can be manufactured by any of ordinary methods such as those described in Japanese Patent O.P.I. Publication No. 133332/1979, British Patent Nos. 725,892 and 729,862 and German Patent No. 3,733,861.

[Processing step]

Each means of the present invention may be used in any processing step wherein the light-sensitive material is processed with a processing solution. However, it is not preferable that the above-mentioned each means are used in a desilvering step (the bleaching step) or processing steps wherein unnecessary materials are removed, but it is preferable that they are used in processing steps wherein dyes are generated or oxidizing reaction is caused. Specifically, the developing step, the color developing step and the bleaching step are preferable.

[Color developing]

The time for the color developing step is the time from when the color developing solution is fed to the light-sensitive material until the processing solution in the next step is fed to the light-sensitive material, or the light-sensitive material is immersed in the processing solution of the next step. The above-mentioned time for the color developing step is preferably 5 or more seconds and specifically preferably 8 or more seconds in terms of stably and sufficiently conducting the color developing step, the time is also preferably 180 or fewer seconds and specifically 60 or less seconds in terms of preventing adverse effects to the light-sensitive material due to the deterioration or drying of the color developing solution fed to the light-sensitive material.

In addition, in the color developing step, plural processing solution feeding means may be provided wherein the first processing solution feeding means feeds the processing solution to the light-sensitive material and that the second processing solution feeding means feeds the color developing solution to the light-sensitive material to which the processing solution is fed from the first processing solution feeding means. In such occasions, the following three embodiments are cited.

The first embodiment is one in which, when the light-sensitive material is subjected to color developing by the use of a color developing agent which becomes active at pH 7 or higher, the first processing solution feeding means feeds the processing solution, whose pH is 6 or less, containing the color developing agent to the light-sensitive material and that the second processing solution feeding means feeds the color developing solution whose pH is 7 or higher. Due to the above-mentioned embodiment, alkaline components having a high diffusion speed are supplied and diffused after the color developing agent having a slower diffusion speed is sufficiently diffused across the width of the light-sensitive material. Accordingly, problems of uneven development due to noticeable difference in the development starting time across the width direction of the light-sensitive layer can be prevented. When the light-sensitive material is a multi-layered color photographic light-sensitive material, light-sensitive properties between each primary colors becomes disrupted when the development starting time is noticeably different across the width direction of the light-sensitive layer. Therefore, this embodiment is specifically useful. In addition, in the case of a multilayer, such as 5 layer or more and specifically 10 layers or more, it is specifically useful.

The second embodiment is one in which the first processing solution feeding means feeds water to the light-sensitive material and that the second processing solution feeding means feeds the color developing solution. Due to the above-mentioned embodiment, the color developing solution is fed, after water is fed to the light-sensitive material and the light-sensitive material is sufficiently swelled. Therefore, even those components whose diffusion speed is slow in a hardened light-sensitive material are diffused at a sufficiently high rate. Accordingly, problems of uneven development due to noticeable differences in the development starting times across the width direction of the light-sensitive layer can be minimized.

The third embodiment is one in which the first processing solution feeding means feeds water containing an oxidant such as a hydrogen peroxide to the light-sensitive material and that the second processing solution feeding means feeds the color developing solution. Due to the above-mentioned embodiment, it is preferable that the color developing agent is a p-phenylenediamine type compound having a water-solubilizing group. At least one of the above-mentioned water-solublilizing group is positioned at an amino group of the p-phenylenediamine type compound or at a benzene nucleus. Practical water-solublilizing group preferably include $—(CH_2)_n—CH_2OH$, $—(CH_2)_m—NHSO_2—(CH_2)_n CH_3$, $—(CH_2)_m—O—(CH_2)_n—CH_3$, $—(CH_2CH_2O)_n C_mH_{2m+1}$, (m and n respectively represent integers of 0 or more) —COOH group, $—SO_3H$ group.

As practically illustrated and preferable compounds of color developing agents, the following (C-1) through (C-18) are cited.

[Illlustrated color developing agent]

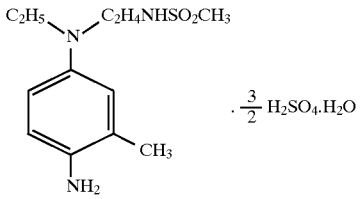
(C-1)

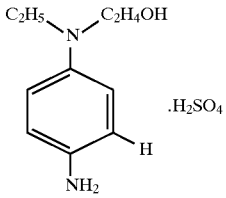
(C-2)

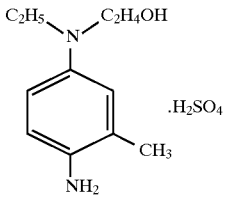
(C-3)

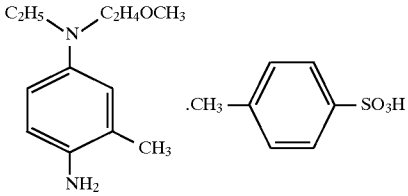
(C-4)

-continued

[Illlustrated color developing agent]

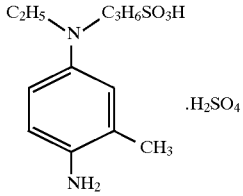
(C-5)

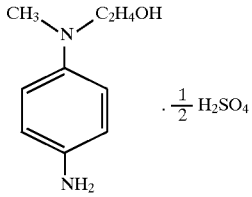
(C-6)

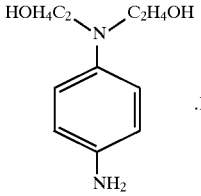
(C-7)

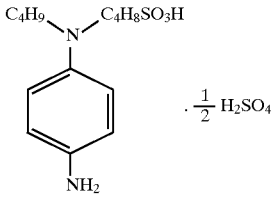
(C-8)

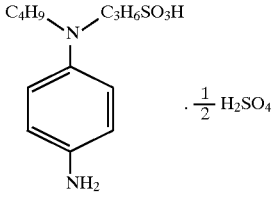
(C-9)

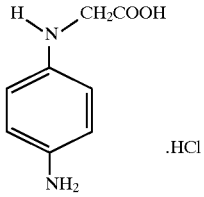
(C-10)

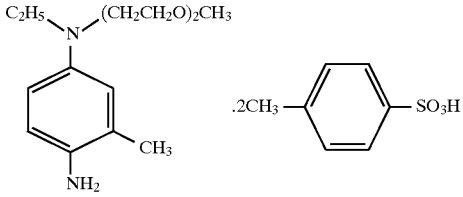
(C-11)

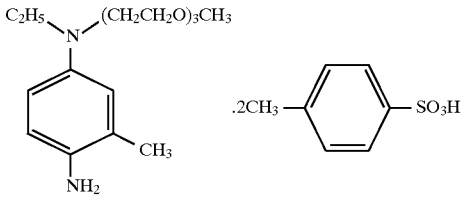
(C-12)

-continued

[Illustrated color developing agent]

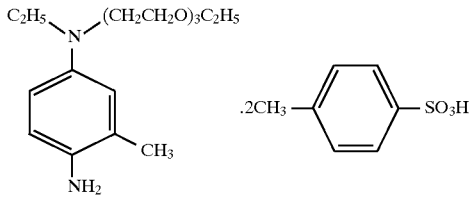

(C-13)

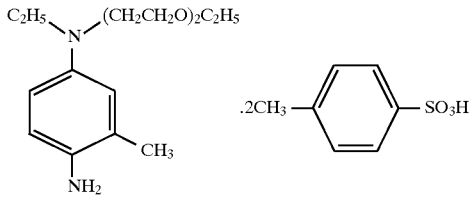

(C-14)

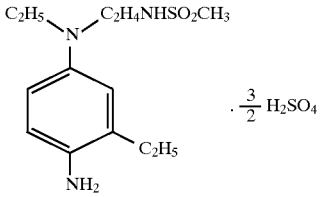

(C-15)

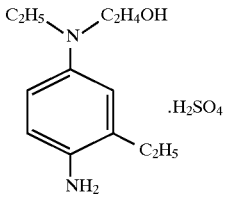

(C-16)

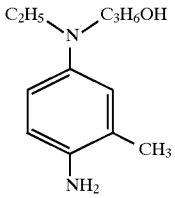

(C-17)

-continued

[Illustrated color developing agent]

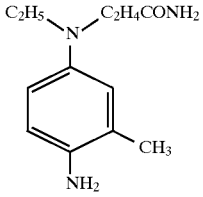

(C-18)

Of the above-mentioned compounds, the preferable compounds are those described by (C-1), (C-2), (C-3), (C-4), (C-15), (C-17) and (C-18).

In addition, the preferable color developing agent is a paraphenylenediamine type color developing agent having a water-solubilizing group represented by the following Formula [P]:

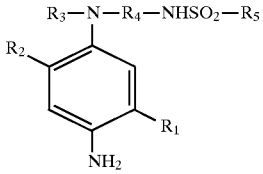

Formula [P]

wherein $R_1$ and $R_2$ independently represent a hydrogen atom, a halogen, an alkyl group, an alkoxy group or an acylamino group; $R_3$ represents an alkyl group; $R_4$ represents an alkylene group; and $R_5$ represents a substituted or unsubstituted alkyl group or an aryl group.

As practically illustrated compounds thereof, in addition to the above-mentioned compounds, the following compounds (C-19) through (C-35) are cited. The above-mentioned compounds are shown by exhibiting practical groups $R_1$ through $R_5$ in Formula [P], which follows.

| | $R_1$ | $R_2$ | $R_3$ | $R_4$ | $R_5$ |
|---|---|---|---|---|---|
| C-19 | —H | —H | —$C_3H_7$ | —$CH_2CH$(—$CH_3$)— | —$CH_3$ |
| C-20 | —$NHCOCH_3$ | —H | —$CH_3$ | —$CH_2CH_2$— | —$CH_3$ |
| C-21 | —H | —H | —$CH_3$ | —$CH_2CH$(—$CH_3$)— | —$CH_3$ |
| C-22 | —$CH_2CH_3$ | —H | —$CH_3$ | —$CH_2CH_2$— | —$CH_3$ |
| C-23 | —$CH_3$ | —H | —$CH_3$ | —$CH_2CH$(—$CH_3$)— | —$CH_2CH_3$ |
| C-24 | —$CH_3$ | —H | —$CH_3$ | —$CH_2CH_2$— | —$CH_2CH_3$ |
| C-25 | —O—$CH_2CH_3$ | —H | —$CH_2CH_3$ | —CH(—$CH_3$)$CH_2$— | —$CH_3$ |
| C-26 | —$NHCOCH_3$ | —H | —$C_3H_7$ | —$CH_2CH_2$— | —$CH_3$ |
| C-27 | —$CH_3$ | —H | —$CH_2CH_3$ | —$CH_2CH_2$— | —$CH_2$—O—$CH_3$ |
| C-28 | —H | —H | —$CH_3$ | —$CH_2CH_2$— | —$CH_2$—N—$(CH_3)_2$ |
| C-29 | —$CH_3$ | —H | —$CH_2CH_3$ | —$CH_2CH_2$— | —$CH_2Cl$ |
| C-30 | —$CH_3$ | —H | —$CH_2CH_3$ | —$CH_2CH_2$— | —$CH_2$—NHCO—$CH_3$ |
| C-31 | —$CH_2CH_3$ | —H | —$CH_2CH_3$ | —$CH_2CH_2$— | —$CH_2$—O—$CH_3$ |
| C-32 | —$CH_3$ | —H | —$CH_2CH_3$ | —$CH_2CH_2$— | —$CH_2$—O—$CH_2CH_3$ |
| C-33 | —$CH_3$ | —H | —$CH_2CH_3$ | —$CH_2CH_2CH_2$— | —$CH_3$ |
| C-34 | —Cl | —H | —$CH_3$ | —$CH_2CH_2CH_2$— | —$CH_3$ |
| C-35 | —O—$CH_3$ | —H | —$CH_2CH_3$ | —$CH_2CH$(—$CH_3$)— | —$CH_3$ |

Of the above-mentioned illustrated compounds, preferable compounds are (C-20), (C-27), (C-29), (C-30) and (C-33). The most preferable compound of the all of the above-mentioned illustrated compounds is (C-1). In addition, compounds represented by Formula [P] can be synthesized in accordance with a method described in Japanese Patent O.P.I. Publication No. 37198/1992. The above-mentioned color developing agents are ordinarily used in a form such as hydrochlorates, sulfates and p-toluene sulfonates.

In addition, the above-mentioned color developing agents can be used independently or two or more admixtures can be used in combination. In addition, if necessary, they may also be used in combination with a black-and-white developing agent such as phenydone, 4-hydroxymethyl-4-methyl-1-phenyl-3-pyrazolidone and Metol.

If compounds represented by following Formulas [H] or [B] are contained in the color developing agent, merits of the color developing agent being stable in terms of photographic performance and fogging occurring in an unexposed portion is less. In addition, when the color developing agent is a solid processing agent, storage stability of the solid processing agent becomes superior compared to other compounds.

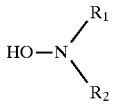

Formula [H]

wherein $R_1$ and $R_2$, which are not concurrently hydrogen atoms, independently represent an alkyl group, an aryl group, R', —CO— group or a hydrogen atom; an alkyl group represented by $R_1$ and $R_2$ may be the same or different, and are preferably an alkyl group having 1 to 3 carbon atoms; the above-mentioned alkyl group may have a carboxylic acid group, a phosphoric acid group, a sulfonic acid group or a hydroxide group; R' represents an alkoxy group, an alkyl group or an aryl group; an alkyl group and an aryl group represented by $R_1$, $R_2$ and R' include those having a substituent; and $R_1$ and $R_2$ may be linked together for forming a ring, for example, heterocycles such as pyperidine, pyridine, triadine or morphorine.

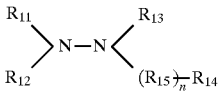

Formula [B]

wherein $R_{11}$, $R_{12}$ and $R_{13}$ independently represents a hydrogen atom, a substituted or unsubstituted alkyl group, aryl group or heterocycle; $R_{14}$ represents a hydroxy group, a hydroxyamino group, a substituted or unsubstituted alkyl group, aryl group, heterocycle, alkoxy group, aryloxy group, carbamoyl group and amino group; the heterocycle, which may be saturated or unsaturated, composed of C, H, O, N, S and a halogen atom, is a 5- or 6-member ring; $R_{15}$ represents a divalent group selected from —CO—, —$CO_2$— or —C(=NH)—; n is 0 or 1; when n=0 specifically, $R_{14}$ represents a group selected from an alkyl group, an aryl group a heterocycle; and $R_{13}$ and $R_{14}$ may form a heterocycle in combination.

Among the compounds represented by Formula [H], compounds represented by the following Formula [D] are specifically preferable:

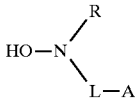

Formula [D]

wherein L represents an alkylene group; A represents a carboxyl group, a sulfo group, a phosphono group, a phosphinic group, a hydroxyl group, an amino group, an ammonio group, a carbamoyl group or a sulfamoyl group; R represents a hydrogen atom or an alkyl group; either of L, A, and R, which may be unsubstituted or substituted, include a straight chain and a branched-chain; and L and R may be linked together for forming a ring.

Next, compounds represented by Formula [D] will be explained further in detail. In the formula, L represents a straight-chained or branched-chained alkylene group, which may be substituted, having 1 through 10 carbon atoms, and preferably having 1 through 5 carbon atoms. Practically, a methylene group, an ethylene group, a trimethylene group and a propylene group are cited as preferable examples. As a substituent, a carboxyl group, a sulfo group, a phosphono group, a phosphinic group, a hydroxyl group and an ammonio group which may be substituted with an alkyl group. The carboxyl group, the sulfo group, the phosphono group and the hydroxyl group are preferable. "A" represents a carboxyl group, a sulfo group, a phosphono group, a phosphinic group, a hydroxyl group, an amino group which may be substituted with an alkyl group, an ammonio group, a carbamoyl group or a sulfamoyl group. The carboxyl group, the sulfo group, the hydroxyl group, the phosphono group and the carbamoyl group which may be substituted with an alkyl group are preferable. Examples of -L-A preferably include a carboxymethyl group, a carboxyethyl group, a carboxypropyl group, a sulfoethyl group, a sulfopropyl group, a sulfobutyl group, a phosphono methyl group, a phosphonoethyl group and a hydroxyethyl group, and specifically preferably include the carboxymethyl group, the carboxyethyl group, the sulfoethyl group, the sulfopropyl group, the phosphono methyl group and the phosphonoethyl group. R represents a hydrogen atom or a straight-chained or branched-chained alkyl group, which may be substituted, having 1 through 5 carbon atoms, and preferably having 1 through 5 carbon atoms. A substituent includes a carboxyl group, a sulfo group, a phosphono group, a phosphinic acid group, a hydroxyl group, an amino group which may be substituted with an alkyl group, an ammonio group, a carbamoyl group or a sulfamoyl group. The substituent may be two or more. R preferably includes a hydrogen atom, a carboxymethyl group, a carboxyethyl group, a carboxypropyl group, a sulfoethyl group, a sulfopropyl group, a sulfobutyl group, a phosphonopropyl group, a sulfoethyl group, a sulfopropyl group, a sulfobutyl group, a phosphonomethyl group, a phosphonoethyl group and a hydroxyethyl group, and specifically preferably includes a hydrogen atom, a carboxymethyl group, a carboxyethyl group, a sulfoethyl group, a sulfopropyl group, a phosphonomethyl group and a phosphonoethyl group. L and R may be linked together for forming a ring.

Next, among the compounds represented by Formula [D], typical examples will be exhibited. However, the present invention is not limited thereto.

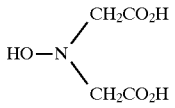
D-(1)
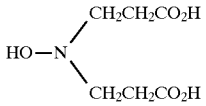
D-(2)
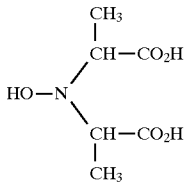
D-(3)
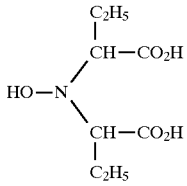
D-(4)
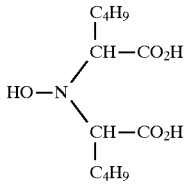
D-(5)
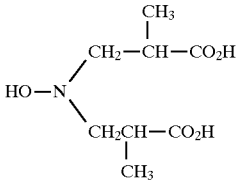
D-(6)
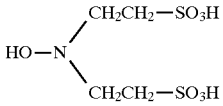
D-(7)
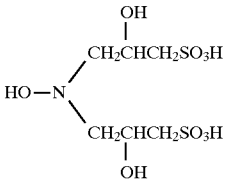
D-(8)
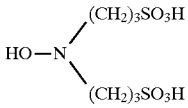
D-(9)
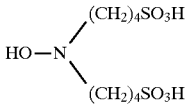
D-(10)
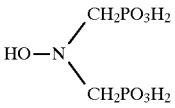
D-(11)
-continued
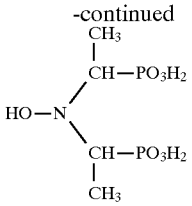
D-(12)
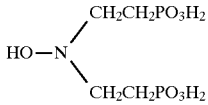
D-(13)
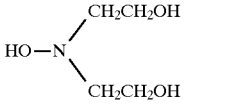
D-(14)
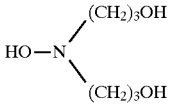
D-(15)
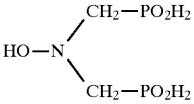
D-(16)
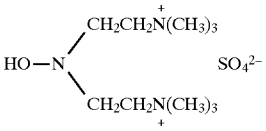
D-(17)
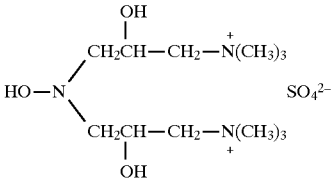
D-(18)
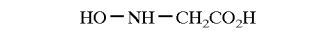
D-(19)
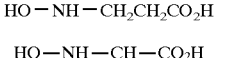
D-(20)
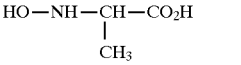
D-(21)
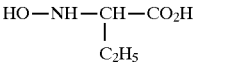
D-(22)
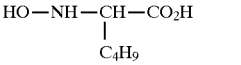
D-(23)
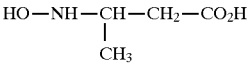
D-(24)
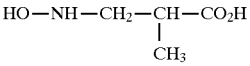
D-(25)
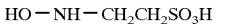
D-(26)
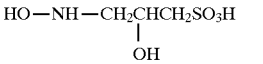
D-(27)
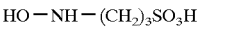
D-(28)
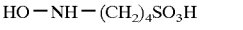
D-(29)

-continued $HO-NH-CH_2PO_3H_2$ D-(30)

$HO-NH-CH(CH_3)-PO_3H_2$ D-(31)

$HO-NH-CH_2CH_2PO_3H_2$ D-(32)

$HO-NH-CH_2CH_2OH$ D-(33)

$HO-NH-(CH_2)_3OH$ D-(34)

$HO-NH-CH_2-PO_3H_2$ D-(35)

D-(36)

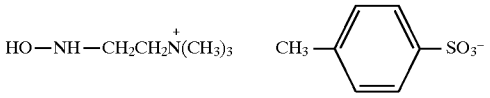

D-(37)

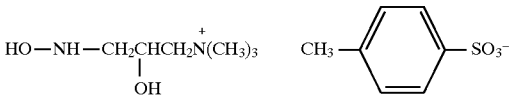

D-(38)

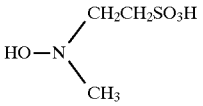

D-(39)

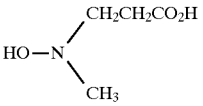

D-(40)

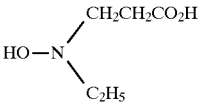

D-(41)

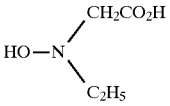

D-(42)

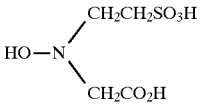

D-(43)

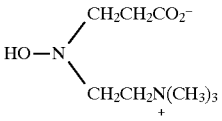

D-(44)

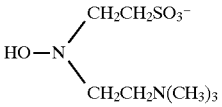

D-(45)

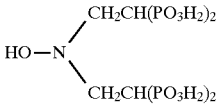

$HONHCH_2CH(PO_3H_2)_2$ D-(46)

D-(47)

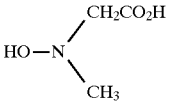

-continued

D-(48)

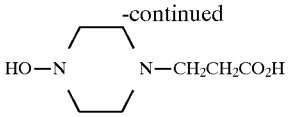

D-(49)

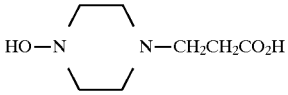

D-(50)

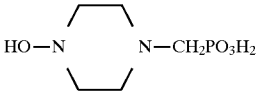

D-(51)

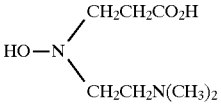

D-(52)

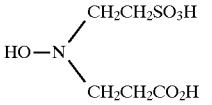

D-(53)

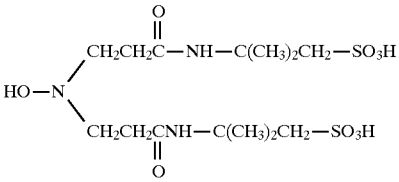

D-(54)

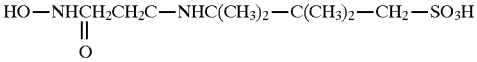

D-(55)

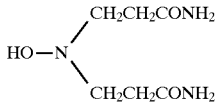

The compounds represented by the above-mentioned Formula [H] or Formula [B] are ordinarily used in the form of an isolated amine, hydrochlorate, sulfate, p-toluenesulfonate, oxalate, phosphate and acetate.

To the color developing solution, a minute amount of sulfite salt can be used as a preserver. Aforesaid sulfite salt includes sodium sulfite, potassium sulfite, sodium bisulfite and potassium bisulfite.

To the color developing solution, a buffer can be added. The buffer preferably includes potassium carbonate, sodium carbonate, sodium bicarbonate, trisodium phosphoric acid, tripotassium phosphoric acid, dipotassium phosphoric acid, sodium borate, potassium borate, sodium tetraboric acid (borate), potassium tetraborate, sodium o-hydroxybenzoic acid (sodium salicylic acid), potassium o-hydroxybenzoic acid, sodium 5-sulfo-2-hydroxybenzoic acid (sodium 5-sulfosalicylic acid) and potassium 5-sulfo-2-hydroxybenzoic acid (potassium 5-sulfosalicylic acid).

To the color developing solution, a development accelerator can be added. As the development accelerator, thioether compounds, p-phenylenediamine compounds, quaternary ammonium salts, p-aminophenols, amine compounds, polyalkyleneoxide, 1-phenyl-3-pyrazolidones, hydrodines, mesoion type compounds, ion type compounds and imidazole can be added as necessary.

It is preferable that the color developing solution substantially does not contain benzyl alcohol.

To the color developing solution, a chlorine ion and a bromine ion can be added in order to prevent fogging. When the chlorine ion is directly added to the color developing solution, as a chlorine ion providing substance, the chloride of sodium, potassium, ammonium, nickel, magnesium, manganese, calcium or cadmium is cited. Of these, preferable chlorides are sodium chloride and potassium chloride. In addition, the chlorine ion may be provided in the form of a paired salt of the fluorescent brightening agent added to the color developing solution. As a chlorine ion providing substance, bromides of sodium, potassium, ammonium, lithium, calcium, magnesium, manganese, nickel, cadmium cerium or thallium are cited. Of these, preferable bromides are potassium bromide and sodium bromide.

It is preferable to incorporate a triazynylstylbene fluorescent brightening agent into the color developing solution from the viewpoint of the effects of the present invention. As such fluorescent brightening agents, compounds represented by the following Formula [E] are preferable:

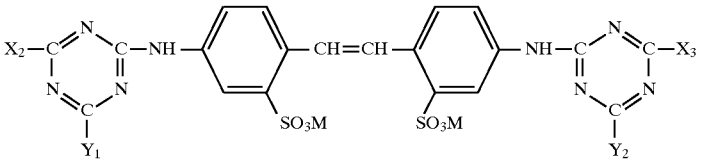

Formula [E]

wherein $X_2$, $X_3$, $Y_1$ and $Y_2$ independently represent a hydroxyl acid, halogen atom such as a chlorine or a bromine, an alkyl group, an aryl group,

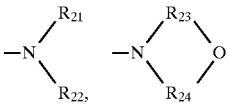

or —$OR_{25}$; $R_{21}$ and $R_{22}$ independently represent an alkylene group (including a substituent), $R_{25}$ represents a hydrogen atom and an alkyl group (including a substituent); and M represents a cation.

In addition, each additive such as anti-staining agents, anti-sludge agents and multi-layer effect promoters may be added.

To the color developing agent and a black and white developing agent component, it is preferable to add a chelating agent represented by the following Formulas [K–I] through [K–V]:

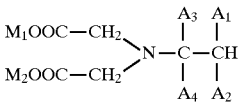

Formula [K-I]

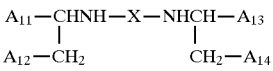

Formula [K-II]

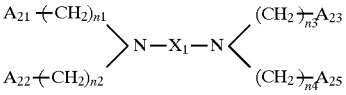

Formula [K-III]

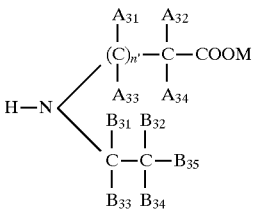

Formula [K-IV]

-continued

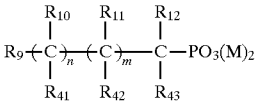

Formula [K-V]

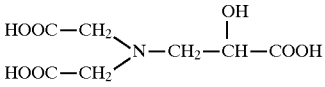

K-I-1

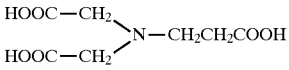

K-I-2

-continued

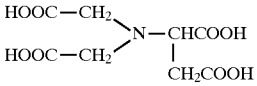

K-I-3

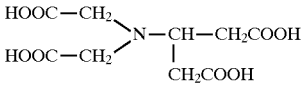

K-I-4

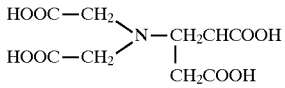

K-I-5

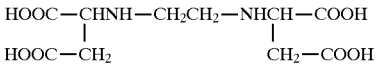

K-II-1

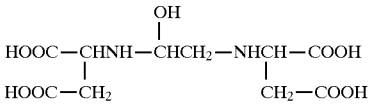

K-II-2

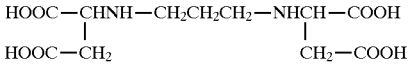

K-II-3

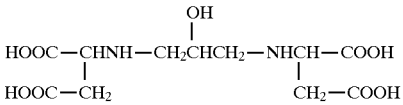

K-II-4

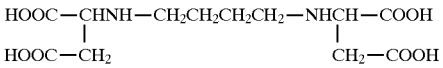

K-II-5

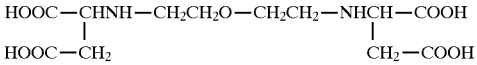

K-II-6

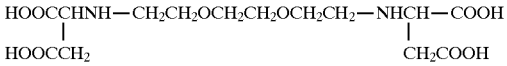

K-II-7

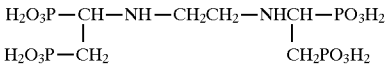

K-II-8

-continued

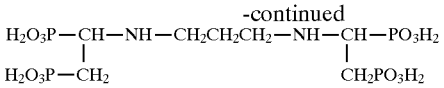
K-II-9

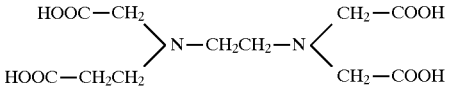
K-III-1

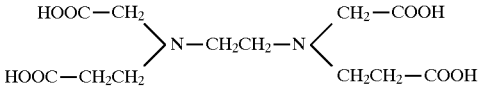
K-III-2

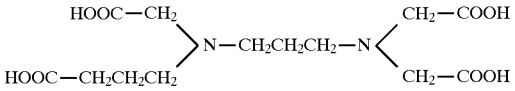
K-III-3

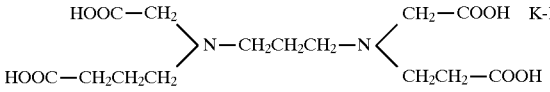
K-III-4

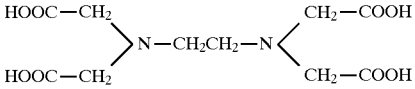
K-III-5

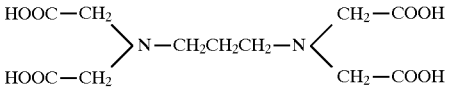
K-III-6

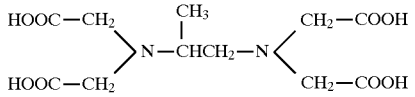
K-III-7

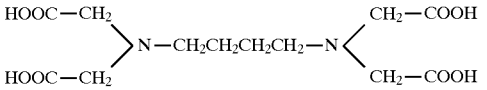
K-III-8

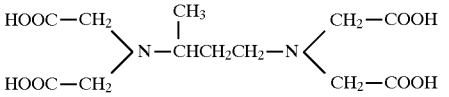
K-III-9

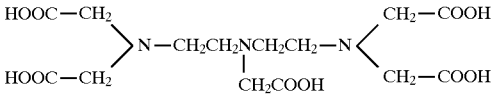
K-III-10

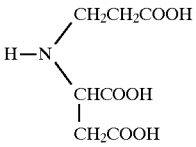
K-IV-1

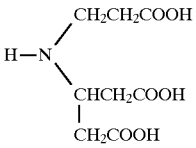
K-IV-2

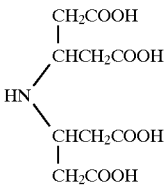
K-IV-3

-continued

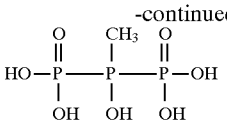
K-V-1

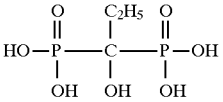
K-V-2

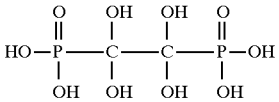
K-V-3

Of the above-mentioned chelating agents, K-I-2, K-II-1, K-II-5, K-III-10, K-IV-1 and K-V-1 are specifically preferable.

In addition, to the above-mentioned color developing agent, an anionic, a cationic, an amphoteric and a non-ionic surfactant can be added. In addition, as necessary, a surfactant such as alkylsulfonic acid, arylsulfonic acid, aliphatic carboxylic acid and aromatic carboxylic acid may be added.

The density of a paraphenylenediamine color developing agent in the color developing solution is preferably 0.018 mol/l or more and specifically 0.020 mol/l or more.

The solid processing agent for color developing solution may be one solid processing agent wherein the color developing agent, the alkaline agent and the preserver are incorporated therein or may also be a set of solid processing agents wherein each part makes a tablet.

[Bleach fixing]

To the bleach-fixing solution, it is preferable to add at least one kind of ferric complex of amino polycarboxylic acid hydrate salt. Also two or more kinds of different ferric complex of amino polycarboxylic acid hydrate salt may be added.

The ferric complex of amino polycarboxylic acid is preferably used in the form of an iron complex of the isolated acid of an amino polycarboxylic acid illustrated below (compounds represented by the following Formula [I]). It is more preferable to use the above-mentioned ferric complex and the isolated acid of an amino polycarboxylic acid in combination. However, it is the most preferable to use the above-mentioned ferric complex and the isolated acid of an amino polycarboxylic acid which is identical to one constituting the above-mentioned ferric complex in combination. In addition, a ferric complex of amino polycarboxylic acid hydrate salt can be used as a potassium salt, a sodium salt and an ammonium salt. The isolated acid of an amino polycarboxylic acid can be used as an isolated acid, potassium salt and a sodium salt.

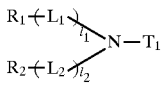
Formula [I]

wherein $T_1$ represents a hydrogen atom, a hydroxy group, a carboxy group, a sulfo group, a carbamoyl group, a phosphono group, a phosphone group, a sulfamoyl group, an alkyl group which may be substituted or unsubstituted, an alkoxy group, an alkylsulfoneamide group, an alkyl thio group, an acylamino group, a hydroxamic acid, hydroxyalkyl group or

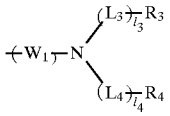

$W_1$ represents an alkylene group which may be substituted or unsubstituted, an arylene group, an alkenylene group, a cycloalkylene group, an aralkylene group or

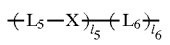

X represents —O—, —S—, divalent heterocycles or

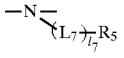

$R_1$ through $R_5$ independently represent a hydrogen atom, a hydroxy group, a carboxy group, a sulfo group, a carbamoyl group, a phosphono group, a phosphone group, a sulfamoyl group, a sulfone amide group, an acylamino group and a hydroxam acid. At least one of $R_1$ through $R_5$ represents a carboxylic group.

$L_1$ through $L_7$ independently represent an alkylene group which may be substituted or unsubstituted, an arylene group, an alkenylene group, a cycloalkylene group or an aralkylene group. $l_1$ through $l_7$ independently represent an integer of 0 through 6, provided that $l_1$ through $l_7$ are not concurrently 0.

Practically illustrated compounds of amino polycarboxylic acid (Illustrated compounds Group 1) represented by Formula [I] which constitutes the ferric complex of amino polycarboxylic acid hydrate salt of the present invention will be exhibited below.

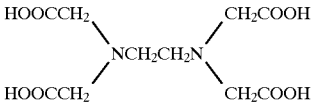

I-1

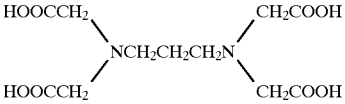

I-2

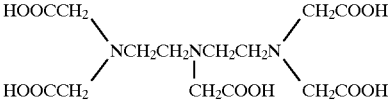

I-3

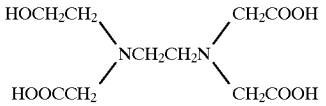

I-4

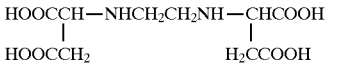

I-5

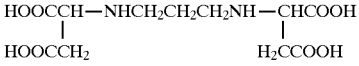

I-6

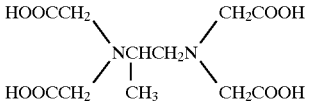

I-7

-continued

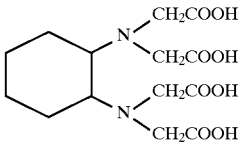

I-8

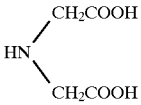

I-9

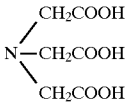

I-10

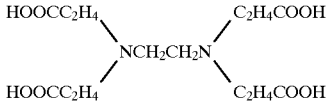

I-11

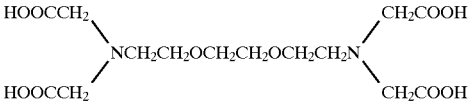

I-12

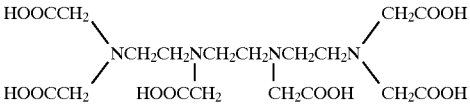

I-13

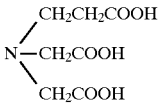

I-14

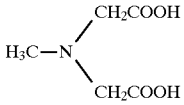

I-15

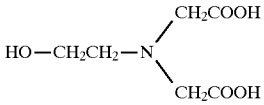

I-16

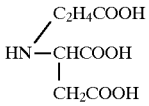

I-17

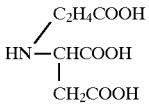

I-18

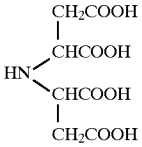

I-19

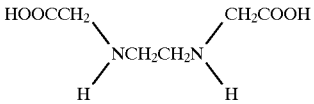

I-20

-continued

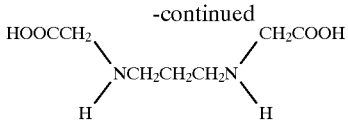
I-21

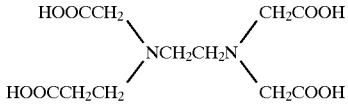
I-22

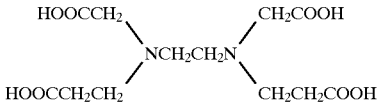
I-23

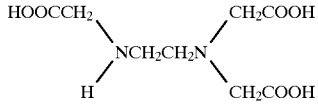
I-24

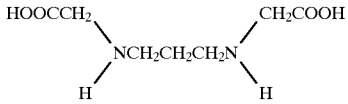
I-25

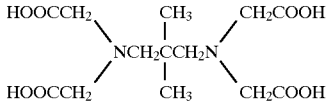
I-26

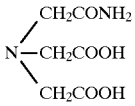
I-27

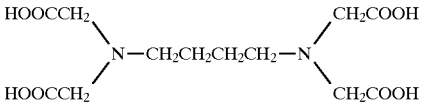
I-28

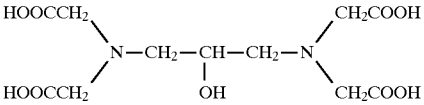
I-29

Compounds providing the effects of the present invention preferably include (I-1) through (I-8), (I-12), (I-14) through (I-20), (I-22), (I-23) and (I-27). Specifically, (I-1), (I-2), (I-3), (I-6), (I-12), (I-14), (I-15) and (I-17) are cited.

Practically illustrated compounds of the ferric complex of amino polycarboxylic acid hydrate salt of the present invention will be exhibited below.

| Illustrated compound Group I ferric (III) complex of amino polycarboxylic acid | | | Amount of crystallization water of ferric (III) complex of amino carboxylic acid Mol number of preferable crystallization water against mol of Fe |
|---|---|---|---|
| Mark | Amino polycarboxylic acid (Illustrated compound Group I) | Paired cation | |
| II-1 | I-1 | $Na^+$ | 3 |
| II-2 | I-1 | $K^+$ | 2 |
| II-3 | I-1 | $NH_4^+$ | 2 |
| II-4 | I-2 | $Na^+$ | 3 |
| II-5 | I-2 | $K^+$ | 1 |
| II-6 | I-2 | $NH_4^+$ | 1 |
| II-7 | I-3 | $K^+$, $H^+$ | 1 |
| II-8 | I-3 | $NH_4^+$, $H^+$ | 1 |
| II-9 | I-5 | $K^+$ | 1 |
| II-10 | I-5 | $NH_4^+$ | 1 |

-continued

| Illustrated compound Group I ferric (III) complex of amino polycarboxylic acid | | | Amount of crystallization water of ferric (III) complex of amino carboxylic acid Mol number of preferable crystallization water against mol of Fe |
|---|---|---|---|
| Mark | Amino polycarboxylic acid (Illustrated compound Group I) | Paired cation | |
| II-11 | I-14 | — | 2 |
| II-12 | I-28 | $K^+$ | 1 |
| II-13 | I-26 | $K^+$ | 1 |
| II-14 | I-10 | — | 1.5 |
| II-15 | I-8 | $NH_4^+$ | 2 |

In addition, it is preferable to incorporate an organic acid compound represented by the following Formula {A} after bleaching:

Formula {A}

$$A(—COOM)_n$$

wherein A represents an n-valent organic group; n represents an integer of 1 through 6; and M represents ammonium, an alkaline metal (sodium, potassium and lithium) or a hydrogen atom.

In Formula [A}, the n-valent organic group represented by A includes an alkylene group (for example, a methylene group, an ethylene group, a trimethylene group and a tetramethylene group), an alkenylene group (for example, an ethenylene group), an alkenylene group (for example, an ethynylene group), a cycloalkylene group (for example, a 1,4-cyclohexanediil group), an arylene group (for example, an o-phenylene group and a p-phenylene group), an alkanetriil group (for example, 1,2,3-propanetriil group) and an arenetriil group (for example, a 1,2,4-benzenetriil group).

The n-valent organic group represented by A includes those (for example, 1,2-hydroxyethylene, hydroxyethylene, 2-hydroxy-1,2,3-propanetriil, methyl-p-phenylene, 1-hydroxy-2-chloroethylene, chloromethylene and chloroethenylene) having a substituent (for example, a hydroxy group, an alkyl group and a halogen atom). Preferable examples of the compounds represented by Formula [A] will be exhibited as follows.

$$HOOCCH_2C(OH)(COOH)CH_2COOH \quad (A\text{-}1)$$

$$HOOC(CHOH)_2COOH \quad (A\text{-}2)$$

$$HOOCCH_2COOH \quad (A\text{-}3)$$

$$HOOCCH(OH)CH_2COOH \quad (A\text{-}4)$$

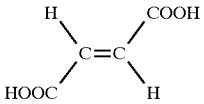
(A-5)

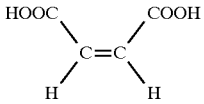
(A-6)

$$(COOH)_2 \quad (A\text{-}7)$$

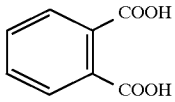
(A-8)

-continued

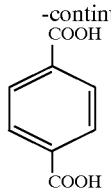
(A-9)

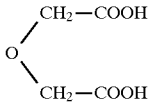
(A-10)

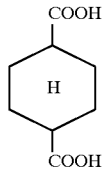
(A-11)

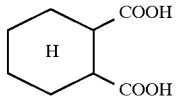
(A-12)

$HOOC{-}(CH_2)_3{-}COOH$ (A-13)

$HOOC{-}(CH_2)_4{-}COOH$ (A-14)

$HOOCC{\equiv}CCOOH$ (A-15)

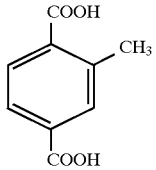
(A-16)

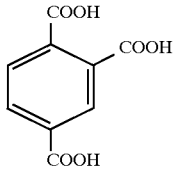
(A-17)

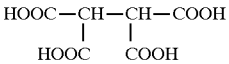
(A-18)

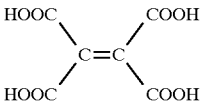
(A-19)

$HO{-}CH_2{-}COOH$ (A-20)

Of the above-mentioned illustrated compounds, the specifically preferable compounds are illustrated compounds (A-1), (A-3), (A-4), (A-5), (A-6_, (A-13), (A-14), (A-15) and (A-20). The most preferable compounds are (A-1), (A-5), (A-6), (A-13), (A-14) and (A-20). As a salt of the above-mentioned acid, ammonium salt, lithium salt, sodium salt and potassium salt are cited. From a viewpoint of storage stability, sodium salt and potassium salt are preferable. The above-mentioned acids and salts of the acids can be used independently, or an admixture can be used. When the above-mentioned ferric complex of amino polycarboxylic acid salt, an organic acid and/or their salt are mixed, it is allowed to granulate each of them and then mix them. However, the effects of the present invention is provided more preferably by mixing directly. In addition, if the above-mentioned granules are compressed, an excellent tablet in terms of strength can be obtained.

To the bleaching solution, a re-halogenating agent may be added. As the re-halogenating agent, conventional agents such as ammonium bromide, potassium bromide, sodium bromide, potassium bromide, potassium chloride, sodium chloride, ammonium chloride, potassium iodide, sodium iodide and ammonium iodide can be used.

It is preferable that a silver halide emulsion used in the present invention comprises at least one emulsion layer containing silver halide particles composed of silver chloride in amount of 90 mol % or more. It is more preferable that the emulsion is composed of the silver chloride in amount of 95 mol % to 99.9 mol %. It is more preferable that the emulsion is composed of the silver chloride in amount of 98 mol % to 99.9 mol %.

EXAMPLES

Hereunder, examples of the present invention will be explained. These examples only exemplify practical examples of the present invention. However, they do not limit the present invention. In addition, though there are decisive descriptions, they also show practical examples as the following Example. They do not limit the present invention.

Example 1

[Apparatus]

FIG. 1 is a schematic diagram of the main portion of the automatic processing machine of Example 1. On the upstream of the conveyance path of silver halide photographic light-sensitive material P, which is processed by the processing solution, heating means 10 which heats silver halide photographic light-sensitive material P is provided. Heating means 10 provides with heating drum 11. Above heating drum 11, roller 12 at the entry area is provided. To the left side of heating drum 11, roller 13 at the exit area is provided. To the left of roller 12 at the exit area and above roller 13 at the entry area, pressure belt driving roller 14 is provided. Pressure belt 15 is mounted on roller 12 at the exit area, roller 13 at the entry area and pressure belt driving roller 14. Due to a structure in which pressure belt 15 is driven over 90° of the circumference of heating drum 11 while it is pressed by heating drum 11, light-sensitive material P is pressed onto heating drum 11 to be conveyed. Due to the above-mentioned structure, light-sensitive material P is heated.

On the downstream from heating drum 11, of light-sensitive material P of conveyance path, developing means 20 is provided. Developing means 20 has processing solution container 21 which houses color developing solution processing light-sensitive material P. Processing solution container 21 is tightly closed against ambient air. As processing solution feeding means 22, a feeding head, described later, is used. Due to this, processing solution feeding means 22 feeds the color developing solution onto the emulsion surface of light-sensitive material P heated by means of heating means 10 through a gas phase.

Light-sensitive material P, subjected to color developing by means of developing means 20, is subjected to bleach-fixing in bleach-fixing solution tank BF, and then, subjected to stabilizing in stabilizing solution tank ST.

[Heating conditions]

By means of heating drum 11 whose surface temperature was regulated to 80° C., the temperature of light-sensitive material P emulsion surface was also heated to 80° C.

[Feeding head]

Figure 11:
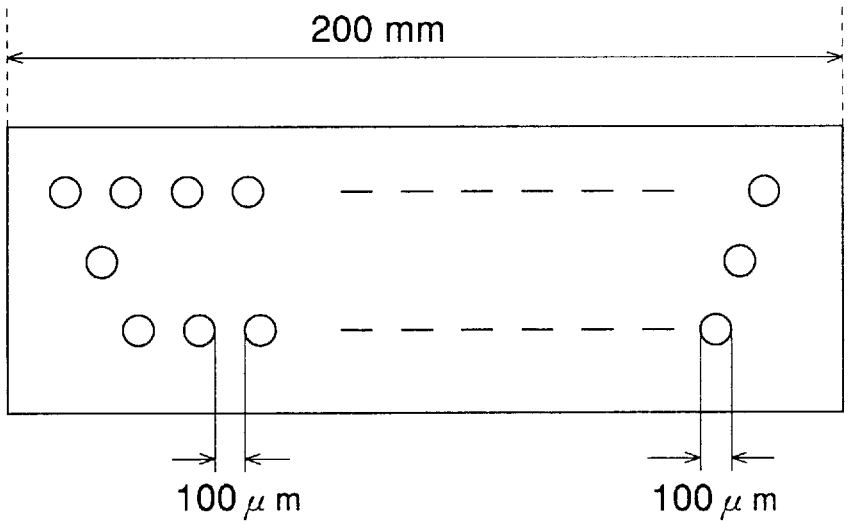
FIG. 11 shows an arrangement of the processing solution feeding head at the feeding port.

A bubble-jet system bar-shaped feeding head is used. This bar-shaped feeding head is positioned perpendicular to the conveyance direction of light-sensitive material P. As shown in FIG. 11, the arrangement of feeding ports are of a double-row alternate arrangement. The interval of the feeding port was 100 $\mu$m in terms of the distance between an edge of one port of that of the adjacent port. The diameter of each feeding port was 100 $\mu$m (the area of the feeding port was $7.85\times10^{-9}$ $m^2$). Feeding frequency of the processing solution is 5000 times per second, and the feeding amount of the processing solution per 1 $m^2$ of silver halide photographic light-sensitive material was 50 ml.

[Light-sensitive material]

QA-A6 paper, produced by Konica Corporation, exposed to light by means of an ordinary method was processed.

[Processing solution formula in the processing solution container]

Per 1 liter:

| | |
|---|---|
| Sodium sulfite | 0.05 g |
| Pentasodium diethylene triamine pentaacetic acid | 3.0 g |
| Polyethylene glycol #4000 | 10.0 g |
| Disodium bis(sulfoethyl)hydroxylamine | 12.0 g |
| Chinopal SFP | 2.0 g |
| Potassium carbonate | 33.0 g |
| Sodium p-toluenesulfonic acid | 20.0 g |
| CD-3 | 10.0 g |
| Potassium hydroxide | 5.0 g |

By the use of potassium hydroxide or sulfuric acid, pH was regulated to 11.0.

[Bleach-fixing step and stabilizing step]

Under the processing conditions stipulated for CPK-2-28 process by Konica Corporation, a light-sensitive material was processed by the use of processing solutions used in aforesaid process.

(Processing condition)

| Process | Processing Times |
|---|---|
| Color development | 10 sec |
| Bleach fixing | 27 sec |
| Stabilizing | 27 × 3 sec |

[Results]

Since the processing solutions were fed after the light-sensitive material was heated by means of a heating drum, more rapid color developing reaction occurred and uneven development was difficult to occur.

In addition, since the feeding amount of the processing solutions was 10 ml/$m^2$ or more, a yellow coloring layer, which was the lowermost layer, was subjected to color developing so that blue density was also sufficient. In addition, since the feeding amount of the processing solutions was 200 ml/$m^2$ or less, the processing solutions did not overflow.

[Additional Example 1']

Additional Example 1' was conducted in the same manner of Example 1 except that a temperature of an emulsion surface of the light-sensitive material P was changed by controlling a temperature of the surface of the heating drum.

As a result, by controlling the temperature of the surface of the light-sensitive material P at a temperature of 40° C. to 100° C., a sufficient density of a color development, in particular, a density of yellow color was obtained. Further, uneven development caused by the lowering of diffusion ability of components in the processing solution could be reduced. That is, a rapid processing ability and a reduction of uneven development could be attained. Furthermore, by controlling the temperature of the emulsion surface of the light-sensitive material P at a temperature of 50° C. to 80° C., it was confirmed that uneven development could be further reduced.

Example 2

[Apparatus]

Figure 2:
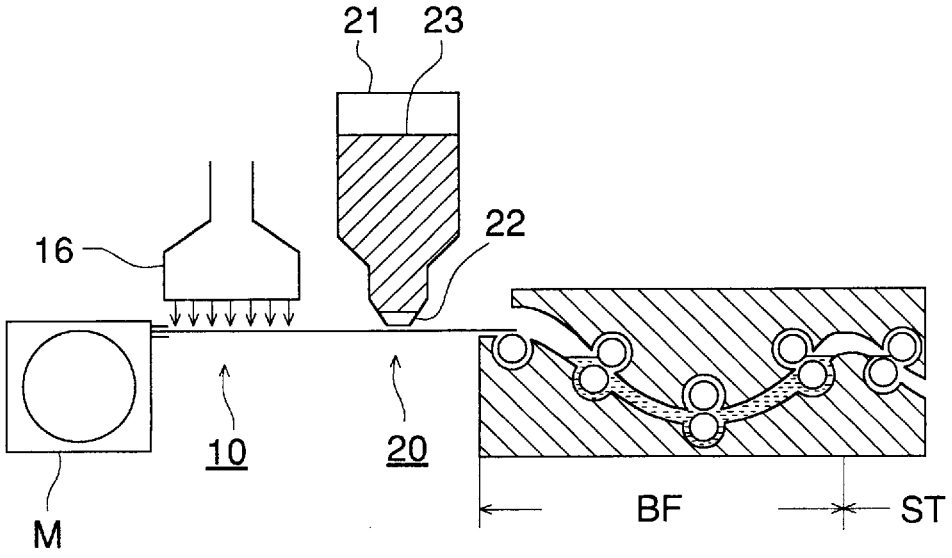
FIG. 2 is a schematic diagram of the main portion of an automatic processing machine of Example 2.
Figure 3:
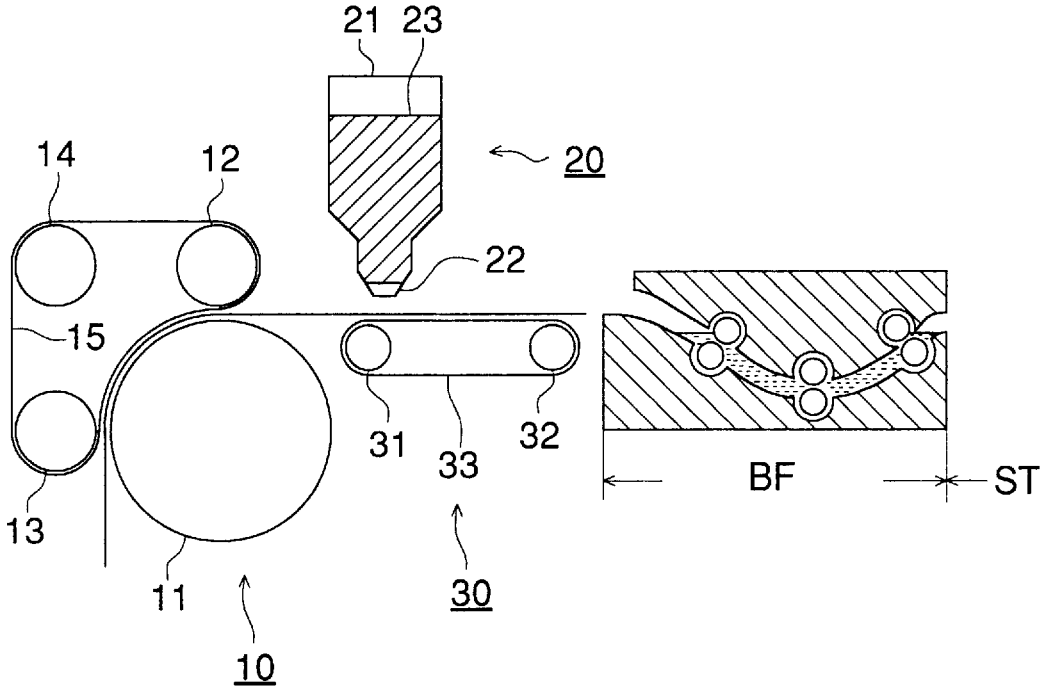
FIG. 3 is a schematic diagram of the main portion of an automatic processing machine of Example 3.

FIG. 2 is a schematic diagram of the main portion of the automatic processing machine of Example 2. On the downstream of the conveyance path of silver halide photographic light-sensitive material P, which is processed by the processing solution, heating means 10 which heats silver halide photographic light-sensitive material P is provided. Heating means 10 comprises heated air blowing means 16. Due to heated air blowing means 16, heated air is blown onto the emulsion surface of light-sensitive material P so that light-sensitive material P is heated.

On the downstream of conveyance path of light-sensitive material P from heated air blowing means 16, developing means 20 is provided. Developing means 20 has processing solution container 21 which houses a color developing solution for processing light-sensitive material P. Processing solution container 21 is tightly closed against ambient air. As processing solution feeding means 22, a feeding head, described later, is used. Due to this structure, processing solution feeding means 22 feeds the color developing solution onto the emulsion surface of light-sensitive material P heated by means of heating means 10 through a gas phase.

Light-sensitive material P, subjected to color developing by means of developing means 20, is subjected to bleach-fixing in bleach-fixing solution tank BF, and then, subjected to stabilizing in stabilizing solution tank ST.

[Heating conditions]

By means of heated air blowing means 16, the emulsion surface temperature of light-sensitive material P was heated to 80° C.

[Feeding head]•[Light-sensitive material]•[Processing solution formula in the processing solution container]•[Bleach-fixing step and stabilizing step]•[Processing condition]

They are identical to Example 1.

[Results]

Since the processing solutions were fed after the light-sensitive material was heated by means of the heated-air blowing means, more rapid color developing reaction occurred and uneven development was difficult to occur.

In addition, since the feeding amount of the processing solutions were 10 ml/$m^2$ or more, a yellow light-sensitive layer, which was the lowermost layer, was subjected to color developing so that the blue density was also sufficient. In addition, since the feeding amount of the processing solutions were 10 ml/$m^2$ or less, the processing solutions did not overflow.

Example 3

[Apparatus]

FIG. 1 is a schematic diagram of the main portion of an automatic processing machine of Example 1. On the upstream of a conveyance path of silver halide photographic light-sensitive material P, which is processed by the processing solution, heating means 10 which heats silver halide photographic light-sensitive material P is provided. Heating means 10 has heating drum 11, Above heating drum 11, there is provided roller 12 at the exit area. At the left side of heating drum 11, there is provided roller 13 at the entry area. Left side of roller 12 at the exit area and above roller 13 at the entry area, pressure belt driving roller 14 is provided. Pressure belt 15 is mounted on roller 12 at the exit area, roller 13 at the entry area and pressure belt driving roller 14. Due to a structure that pressure belt 15 is driven over 90° of the circumference of heating drum 11 while it is pressed by heating drum 11, light-sensitive material P is pressed onto heating drum 11 to be conveyed. Due to the above-mentioned structure, light-sensitive material P is heated.

On the downstream of conveyance path of light-sensitive material P from heating drum 11, developing means 20 is provided. Developing means 20 has processing solution container 21 which houses a color developing solution processing light-sensitive material P. Processing solution container 21 is tightly closed against ambient air. As processing solution feeding means 22, a feeding head, described later, is used. Due to this, processing solution feeding means 22 feeds the color developing solution onto the emulsion surface of light-sensitive material P heated by means of heating means 10 through a gas phase.

Between the upstream side and the downstream side of the conveyance path of light-sensitive material, where the processing solution was fed through a gas phase by means of processing solution feeding means 22, second heating means 30 was provided. Second heating means 30 comprises heating roller 31, driving roller 32 and heating belt 33. Heating belt 33 is mounted on heating roller 31 and driving roller 32. Heating roller 31, located at upstream side of light-sensitive material P from a point where the processing solution is fed through a gas phase by means of processing solution feeding means 22, heats heating belt 33. Driving roller 32, located at the downstream side of the conveyance path of light-sensitive material P, from heating roller 31. Thus, processing solution feeding means 22 feeds the processing solution onto the emulsion surface of silver halide photographic light-sensitive material P through a gas phase, which is being heated by second heating means 30. In other words, the silver halide photographic light-sensitive material wherein the processing solution was fed onto the emulsion surface through a gas phase was heated by means of second heating means 30.

Following this, light-sensitive material P, subjected to color developing by means of developing means 20, is also subjected to bleach-fixing in bleach-fixing solution tank BF, and then, subjected to stabilizing in stabilizing solution tank ST.

[Heating conditions]

By means of heating drum 11 whose surface temperature was regulated to 80° C., the emulsion surface temperature was heated to 80° C.

[Second heating condition]

By means of heating belt 33 whose surfce temperature was 80° C., the light-sensitive material was heated from the emulsion surface side for maintaining the temperature of the emulsion surface side of the light-sensitive material at 80° C.

[Feeding head]•[Light-sensitive material]•[Processing solution formula in the processing solution container]•[Bleach-fixing step and stabilizing step]•[Processing condition]

They are identical to Example 1.

[Results]

Since the processing solutions were fed after the light-sensitive material was heated by means of a heating drum, more rapid color developing reaction occurred and uneven development was difficult to occur.

In addition, since the feeding amount of the processing solutions were 10 ml/m$^2$ or more, a yellow light-sensitive layer, which was the lowermost layer, was subjected to color developing so that the blue density was also sufficient. In addition, since the feeding amount of the processing solutions was 10 ml/m$^2$ or less, the processing solutions did not overflow.

Example 4

Figure 4:
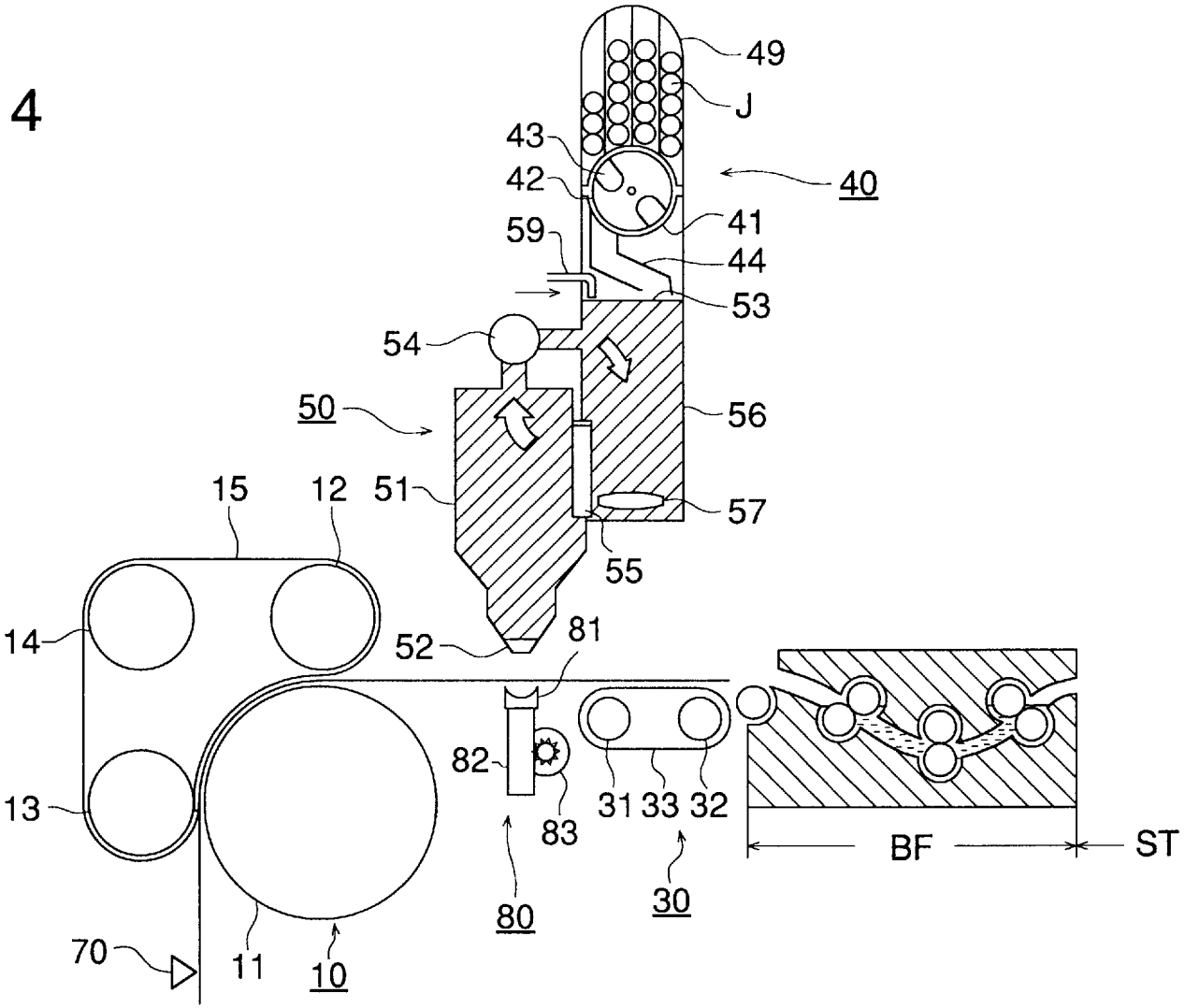
FIG. 4 is a schematic diagram of the main portion of an automatic processing machine of Example 4.
Figure 5:
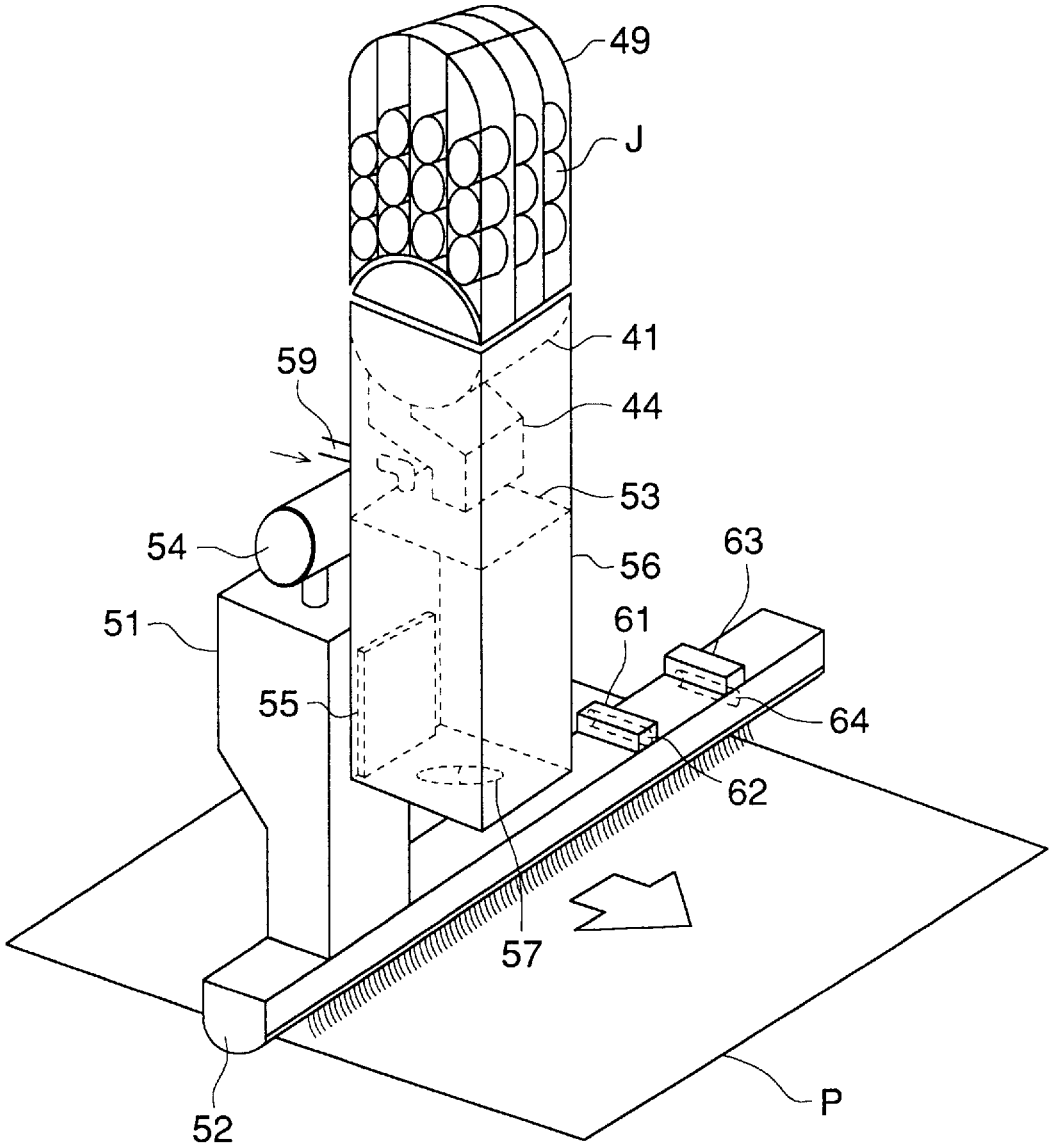
FIG. 5 is a perspective view of the main portion of an automatic processing machine of Example 4.
Figure 6:
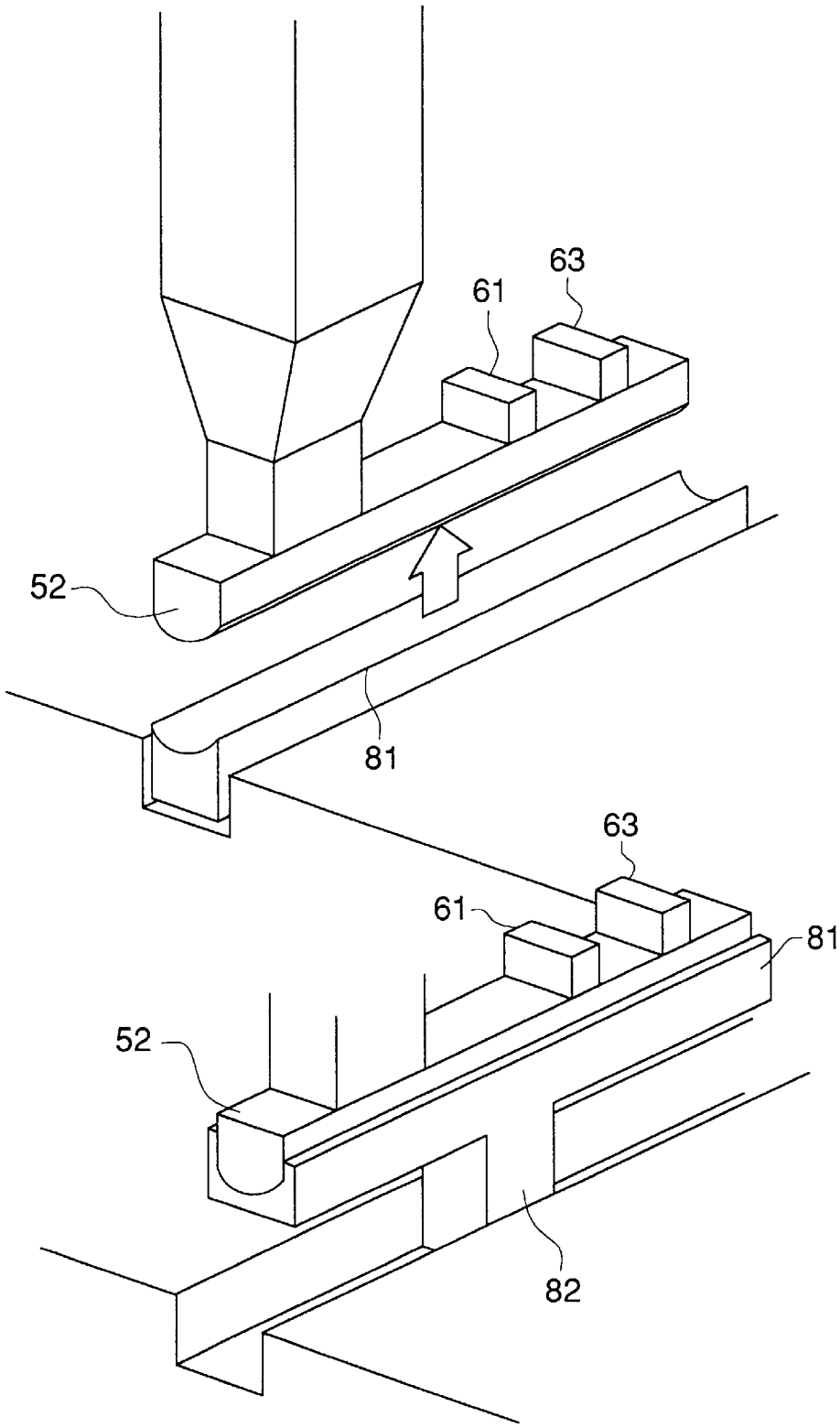
FIG. 6 is a perspective view in the vicinity of a feeding port drying preventing means in an automatic processing machine of Example 4.

FIG. 4 is a schematic diagram of the main portion of the automatic processing machine of Example 4. FIG. 5 is a perspective view of the main portion of the automatic processing machine of Example 4. FIG. 6 is a perspective view in the vicinity of a feeding port drying preventing means in the automatic processing machine of Example 4.

The conveyance means, which conveys silver halide photographic light-sensitive material P at a prescribed speed, include heating drum 11, pressure belt 15, heating belt 33 and conveyance rollers in and after the bleach-fixing tank, in addition to other conveyance rollers not illustrated. In addition, there is provided light-sensitive material sensing means 70, which senses the existence of light-sensitive material P, at a prescribed position on the upstream side in the conveyance direction of the conveyance means from a position where processing solution feeding means 20 feeds the processing solution. Heating means 10, which heats silver halide photographic light-sensitive material P, on the downstream of the conveyance path of light-sensitive material P from light-sensitive material sensing means 70, is provided. On heating means 10, heating means 11 is provided. Above heating drum 11, roller 12 at the exit area is provided. Left side of heating drum 11, roller 13 at the entry area is provided. Left side of roller 12 at the exit area and above roller 13 at the entry area, pressure belt driving roller 14 is provided. Pressure belt 15 is mounted on roller 12 at the exit area, roller 13 at the entry area and pressure belt driving roller 14. Due to a structure in which pressure belt 15 is driven over 90° of the circumference of heating drum 11 while it is pressed by heating drum 11, and light-sensitive material P is pressed onto heating drum 11 to be conveyed. Due to the above-mentioned structure, light-sensitive material P is heated.

On the lowerstream of the conveyance path of light-sensitive material P from heating drum 11, developing means 50 is provided. As the processing solution container which houses the processing solution (the color developing solution) processing light-sensitive material P, developing means 50 has first processing solution container 51 and second processing solution container 56. First processing solution container 51 and second processing solution container 56 are tightly closed against ambient air. As processing solution feeding means 52, the feeding head described later is used. Due to this, processing solution feeding means 52 feeds the color developing solution onto the emulsion surface of light-sensitive material P heated by means of heating means 10 through a gas phase. Above first processing solution container 51 and at the left side of second processing solution container 56, circulation pump 54 is provided. At a wall between first processing solution container 51 and second processing solution container 56, filter 55 is provided. By operating circulation pump 54, the color developing solution is circulated from first processing solution container 51 to circulation pump 54, second processing solution container 56 and filter 55. In addition, rotator 57 spines in second processing solution container 56 for stirring the processing solution in second processing solution container 56.

A filtration means (filter 55), which filtrates the processing solution flowed from second processing solution container 56 is provided, between second processing solution container 56 and processing solution feeding means 52. In other words, a filtration means (filter 55) is provided, which filtrates the processing solution, the downstream, from a region (second processing solution container 56) where the solid processing agent is supplied by means of processing agent supplying means 40 in the circulation path of the processing solution which circulates by means of the circulation means (circulation pump 54), and at the upstream, from a region (first processing solution container 51) where the processing solution fed, by means of processing solution feeding means 52, in the circulation path.

In addition, to second processing solution container 56, replenisher water is fed from replenisher water feeding means 59. In addition, on processing solution surface 53 of second processing solution container 56, solid processing agent supplying means 40 which supplies the solid processing agent for the silver halide photographic light-sensitive material is provided. Solid processing agent supplying means 40 has quantitative supplying section 41 which supplies the solid processing agent by a prescribed amount from solid processing agent container 49 and introducing section 44 which introduces the solid processing agent supplied from quantitative supplying section 41. As the solid processing agent, tablet J is used so that quantitative control is improved and fluctuation of processing agent components inside the processing agent container can be reduced. Inside solid processing agent container 49 is divided into 16 compartments (4 lines×4 rows, plural rooms) by means of partitions so that, in each compartment, tablets can be housed substantially in point-contact or line-contact. Due to the above-mentioned structure, sticking of the solid processing agents each other can be prevented. Specifically, in the case of the present invention, the volume of the processing solution container can be reduced. For this purpose, the dimensions of the tablet must be reduced compared to conventional types. Therefore, sticking of the solid processing agents each other easily occurs. Accordingly, the above-mentioned structure is specifically useful. Inside quantitative supplying section 41, rotation rotor 42 is provided. Receiving cavities 43 are provided corresponding to 2 lines of compartments in solid processing agent container 49 so that every time rotation rotor 42 is rotated by 180°, 2 tablets J are pocketed by receiving cavities 43, and then, from receiving cavities 43 to introducing section 44, 2 tablets L are supplied each time. In the above-mentioned occasion, except when the solid processing agents are supplied, rotation rotor 42, except receiving cavities 43, faces introducing section 44. This mechanism prevents entrance of moisture into solid processing agent container 49 side from the processing solution by means of the above-mentioned rotation rotor 42. Introducing section 44 is a gentle-curve-shape S shaped. Due to this structure, falling of the solid processing agent vigorously into processing solution surface 53 for splashing the solution is prevented, and concurrently with, funneling of a large amount of moisture from the processing solution to rotation rotor 42 is also prevented. Specifically, in the case of the present invention, the volume of the processing solution container can be reduced. For this purpose, the dimensions of the tablet must be reduced compared to conventional types. Therefore, sticking of the solid processing agent and rotation rotor 42 easily occurs. Accordingly, the above-mentioned structure is specifically useful.

On processing solution feeding means 52, first shutter 62 and second shutter 64 which stop the feeding of the processing solution to the feeding head at the middle of the width direction of light-sensitive material P. First shutter 62 is driven into the feeding path of the processing solution to the feeding head insertably/detachably by means of first shutter driving unit 61, and second shutter 62 is driven into the feeding path of the processing solution to the feeding head insertably/detachably by means of second shutter driving unit 63. FIG. 5 shows a state when second shutter 64 is inserted into the feeding path of the processing solution to the feeding head.

Below processing solution feeding means 52, feeding port drying prevention means 80 is provided, which covers the feeding port of the feeding head when the processing solution is not fed to light-sensitive material P in order to prevent drying of the processing solution on the feeding port of the feeding head on processing solution feeding means 52. Feeding port drying prevention means 80 is composed of movable lid 81, supporting bar 82 which supports movable lid 81 and motor 83 whichraises/lowers supporting bar 82 upward/downward. Due to a structure that supporting bar 82 is provided with a rack and motor 83 is provided with a pinion, supporting bar 82 is driven upward/downward by means of motor 83. The cross sectional view of movable lid 81 is concave. As described later, in a stand-by status when light-sensitive material P is not processed, processing solution feeding means 52 periodically feeds the processing solution. In this instance, movable lid 81 is moved slightly downward, and it receives the processing solution fed from processing solution feeding means 52, and then, the processing solution is drained to the effluent unit through a hole, not illustrated, provided in supporting bar 82. Thus, contamination of peripheral apparatuses due to the above-mentioned processing solution is prevented.

Second heating means 30, which heats light-sensitive material P, on the downstream in the conveyance path from light-sensitive material P where the processing solution is fed thereto through a gas phase by means of processing solution feeding means 52 is provided. Second heating means 30 is provided with heating roller 31, driving roller 32 and heating belt 33. Heating belt 33 is mounted on heating roller 31 and driving roller 32. Heating roller 31 is positioned on downstream in the conveyance path from a point where the processing solution is fed through gas phase by means of processing solution feeding means 22 onto light-sensitive material P for heating heating belt 33. Driving roller 32, which is positioned on downstream in the conveyance path of light-sensitive material P from heating roller 31 drives heating belt 33. Due to the above-mentioned structure, heating belt 33, being heated, heats light-sensitive material P. Accordingly, second heating means 30 heats the silver halide photographic light-sensitive material wherein the processing solution is fed to its emulsion surface through a gas phase by means of processing solution feeding means 22.

Following this, light-sensitive material P, subjected to color developing by means of developing means 20, is subjected to bleach-fixing in bleach-fixing solution tank BF, and then, subjected to stabilizing in stabilizing solution tank ST.

[Control of the apparatus]

Figure 7:
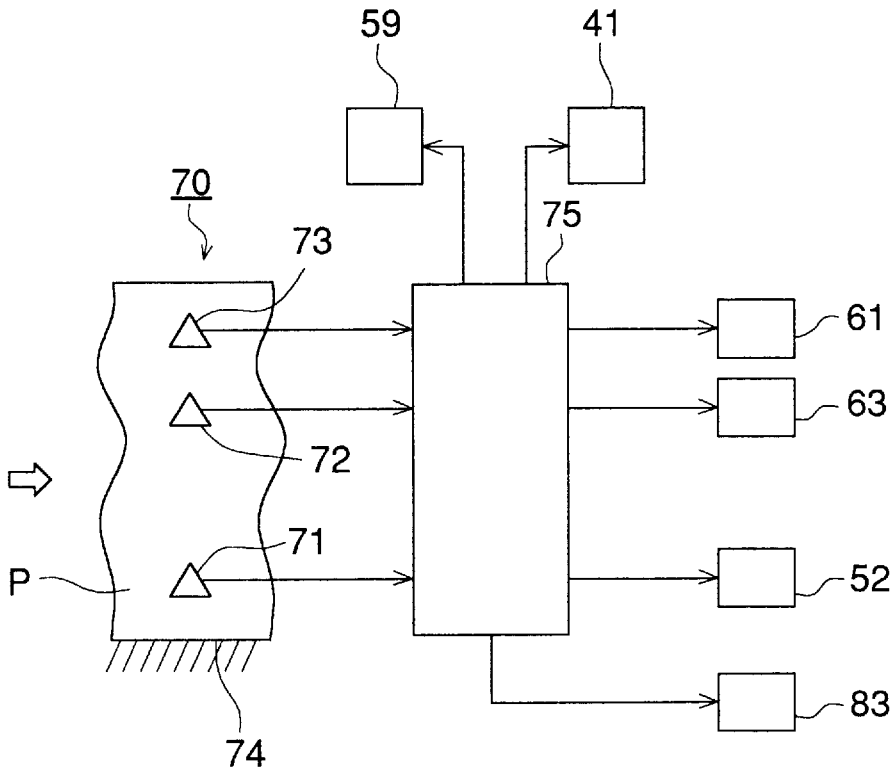
FIG. 7 is a main block diagram of an automatic processing machine of Example 4.

FIG. 7 shows a main block diagram of the automatic processing machine in Example 4. As shown in FIG. 7, light-sensitive material sensing means 70, which senses the existence of light-sensitive material P at a prescribed position at on the upstream in the conveyance direction of the conveyance means from a position where processing solution feeding means 52 feeds the processing solution, provides several light-sensitive material sensing sensors across the width direction of light-sensitive material P, while one end of light-sensitive material P is slid against positioning wall 74, so that the width of light-sensitive material P is sensed by means of several light-sensitive material sensing sensors. The above-mentioned several light-sensitive material sensing sensors are composed of first light-sensitive material sensing sensor 71 (for example, at a position of 30 mm from positioning wall 74), second light-sensitive material sensing sensor 72 (for example, at a position of 95 mm from positioning wall 74) and third light-sensitive material sensing sensor 73 (for example, at a position of 110 mm from positioning wall 74). Operational control unit 75 determines the width of light-sensitive material P from the sensing results of the above-mentioned sensors, as shown in t table below. When first light-sensitive material sensing sensor 71 senses the existence of light-sensitive material P and second light-sensitive material sensing sensor 72 and third light-sensitive material sensing sensor 73 sense no light-sensitive material P, it is determined that the width of light-sensitive material P is narrow (for example, 89 mm or less). When first light-sensitive material sensing sensor 71 and second light-sensitive material sensing sensor 72 sense the existence of light-sensitive material P and third light-sensitive material sensing sensor 73 senses no light-sensitive material P, it is determined that the width of light-sensitive material P is of medium width (for example, 100 to 105 mm). When first light-sensitive material sensing sensor 71, second light-sensitive material sensing sensor 72 and third light-sensitive material sensing sensor 73 sense the existence of light-sensitive material P, it is determined that the width of light-sensitive material P is long (for example, 125 to 130 mm). Other cases are judged to be abnormal.

In addition, operational control unit 75 also functions as a control means which modifies the width of the processing solution fed by processing solution feeding means 52 in accordance with the width of light-sensitive material P sensed by light-sensitive material sensing means 70. Operational control unit 75 controls first shutter driving unit 61 and second shutter driving unit 62, as shown in the Table below, in accordance with the width of sensed light-sensitive material P. When it determines that the width of sensed light-sensitive material P is narrow (for example, 89 mm or less), first shutter 62 (positioned at 95 mm from one end of light-sensitive material P) is inserted to the feeding path of the processing solution to the feeding head by means of first shutter driving unit 61. When it is determined that the width of sensed light-sensitive material P is middle (for example, 100 to 105 mm), first shutter 62 is removed from the feeding path by means of first shutter driving unit 61 and second shutter 64 (positioned at 110 mm from one end of light-sensitive material P) is inserted to the feeding path of the processing solution to the feeding head by means of second shutter driving unit 63. When it determines that the width of sensed light-sensitive material P is of full width(for example, 125 through 130 mm), first shutter 62 is removed from the feeding path by means of first shutter driving unit 61 and second shutter 64 is also removed from the feeding path by means of first shutter driving unit 63. When it is determined to be abnormal, an alarm sounds.

TABLE 1

| First light-sensitive material sensing sensor | Second light-sensitive material sensing sensor | Third light-sensitive material sensing sensor | judgment of the width of light-sensitive material | First shutter | Second shutter |
|---|---|---|---|---|---|
| Exist | Exist | Exist | Long | Removed | Removed |
| Exist | Exist | Not exist | Middle | Removed | Inserted |
| Exist | Not exist | Exist | Abnormal | — | — |
| Exist | Not exist | Not exist | Short | Inserted | — |
| Not exist | Exist | Exist | Abnormal | — | — |
| Not exist | Exist | Not exist | Abnormal | — | — |
| Not exist | Not exist | Exist | Abnormal | — | — |
| Not exist | Not exist | Not exist | Abnormal | — | — |

In place of second light-sensitive material sensing sensor 72 and third light-sensitive material sensing sensor 73, the width of light-sensitive material P may be sensed by means of a magazine-housed light-sensitive material width sensing sensor which senses the display of the width of housed light-sensitive material provided in a magazine which houses light-sensitive material P.

Due to a structure in which operational control unit 75 controls processing solution feeding means 52 in such a manner that it starts feeding of the processing solution after passage of a prescribed time since light-sensitive material sensing means 70 last sensed the existence of light-sensitive material P at the above-mentioned prescribed position from non-existence and that processing solution feeding means 52 finishes feeding of the processing solution after passage of prescribed time since light-sensitive material sensing means 70 last sensed the non-existence of light-sensitive material P at the above-mentioned prescribed position from existence, light-sensitive material P is conveyed at a prescribed conveyance speed by means of the above-mentioned conveyance means. Therefore, it can be controlled that, when light-sensitive material P exists before the processing solution is fed by means of processing solution feeding means 52, processing solution feeding means 52 feeds the processing solution onto light-sensitive material P. The above-mentioned prescribed time can be calculated from a distance between the above-mentioned prescribed position and a point where processing solution feeding means 52 feeds the processing solution onto light-sensitive material P and a prescribed conveyance speed. It can be controlled in accordance with a predetermined value and it may also be controlled while sensing the conveyance speed.

In addition, when processing solution feeding means 52 does not feed the processing solution to light-sensitive material P, operational control unit 75 controls feeding port drying prevention means 80 which covers the feeding port of the feeding port. When operational control unit 75 senses the existence of light-sensitive material P at the above-mentioned prescribed position from non-existence, it controls a motor wherein it removes movable lid 81 from the feeding port of the feeding head so that it removes movable lid 81 from the conveyance path of light-sensitive material P. By controlling movable lid 81 in such a manner that it covers the feeding port of the feeding head after a prescribed time+$\alpha$ since light-sensitive material sensing means 70 last sensed the existence of light-sensitive material P at the above-mentioned prescribed position from non-existence, operational control unit 75 controls feeding port drying prevention means 80 in a manner that it is obstructive when processing solution feeding means 52 feeds the processing solution to light-sensitive material P. In addition too, in a stand-by status when light-sensitive material P is not processed, processing solution feeding means 52 periodically feeds the processing solution. In this occasion, operational control unit 75 functions as follows. Before, processing solution feeding means 52 feeds the processing solution, operational control unit 75 controls motor 83 so that movable lid is slightly moved downward. Due to second shutter driving unit 63, second shutter 64 is removed from the feeding path of the processing solution to the feeding head. Following this, the processing solution is fed by processing solution feeding means 52. When feeding is finished, operational control unit 75 controls motor 83 so that movable lid 81 covers the feeding port of the feeding head. Clogging of all feeding ports can be prevented by that processing solution feeding means 52 feeds the processing solution after first shutter 62 and second shutter 64 are removed from the feeding path of the processing solution to the feeding head.

In addition, operational control unit 75 calculates the area of processed light-sensitive material P by time since the existence of light-sensitive material P at the above-mentioned prescribed position from non-existence until the non-existence of light-sensitive material P from existence and by the width of sensed light-sensitive material P. Operational control unit 75 controls replenisher water feeding means 59 in a manner that the area of processed light-sensitive material P calculated is accumulated and, every time the accumulation of the area of processed light-sensitive material P calculated reaches the prescribed area, replenisher water is fed to second processing solution container 56. In addition, operational control unit 75 also controls quantitative supplying unit 41 of solid processing agent supplying means 40 in a manner that the solid processing agent for the silver halide photographic light-sensitive material is fed to second processing solution container 56. Due to the above-mentioned structure, stable replenishment of the solid processing agent and the replenisher water in accordance with the feeding amount of the processing solution from processing solution feeding means 52 can be conducted.

[Heating conditions]

By means of heating drum 11 whose surface temperature was 80° C., the emulsion surface temperature of light-sensitive material P was heated to 80° C.

[Second heating condition]

By means of heating belt 33, the light-sensitive material was controlled to be heated at 80° C. from the emulsion surface side for maintaining the temperature of the emulsion surface side of light-sensitive material at 80° C.

[Feeding head]

A bubble-jet system bar-shaped feeding head is used. On this head, a heating means (a heating coil) which heats the processing solution at the processing solution feeding means is provided. Due to this, the processing solution fed by means of the processing solution feeding means is heated. As shown in FIG. 11, the arrangement of feeding ports are of a double-row alternate arrangement. The interval of feeding ports was 100 $\mu$m in terms of a distance between the edge of one port and that of the adjacent port. The diameter of feeding ports was 100 $\mu$m (the area of the feeding port was $7.85\times10^{-9}$ $m^2$). Feeding frequency of the processing solution is 5000 times per second, and the feeding amount of the processing solution per 1 $m^2$ of silver halide photographic light-sensitive material was 50 ml.

[Light-sensitive material]

QA-A6 paper, produced by Konica Corporation, was used.

[Preparation method of tablet J for color developing solution]

Procedure (1)

In a commercially available bandam mill, 1000 g of developing agent CD-3, i.e., 4-amino-3-methyl-N-ethyl-[β (methanesulfoneamide)ethyl aniline sulfate was crushed until the average particle size becomes 10 $\mu$m. To these fine particles, 1000.0 g of polyethylene glycol whose average molecular weight by weight was 6000 was added, and then, the resulting mixture was mixed uniformly. Next, in a commercial stirring granulating machine, 50 ml of water was added to the above-mentioned mixture for 7 minutes at room temperature for granulating. Following this, the granulated product was dried for 2 hours at 40° C. in a fluid bed layer drier for substantially removing moisture completely.

Procedure (2)

In the same manner as in Procedure (1), 400.0 g of disodium bis(sulfoethyl)hydroxylamine, 1700.0 g of sodium p-toluenesulfonic acid and 300.0 g of Chinopal SFP (produced by Ciba-Guigy) were respectively crushed. The above-mentioned products and 240.0 g of Pine Flow (produced by Matsutani Chemical Co., Ltd.) were mixed uniformly in a commercially available mixer. Next, in the same manner as in Procedure (1), the resulting mixture was granulated wherein added amount of water was 60 ml. The granulated product was dried at 50° C. for 2 hours for substantially removing moisture in the granulated product completely.

Procedure (2)

In the same manner as in Procedure (1), 330.0 g of pentasodium diethylenetriamine pentaacetic acid, 130.0 g of sodium p-toluenesulfonic acid, 37.0 g of sodium sulfite, 340.0 g of lithium hydroxide monohydride and 3300.0 g of potassium carbonate anhydrate were respectively crushed. The above-mentioned products, 500.0 g of polyethylene glycol whose average molecular weight by weight 4000 and 600.0 g of Mannitol were mixed uniformly in a commercially available mixer in a room where humidity was regulated to 40% RH or less. Next, in the same manner as in Procedure (1), the resulting mixture was granulated wherein added amount of water was 800 ml. The granulated product was dried at 60° C. for 30 minutes for substantially removing moisture in the granulated product completely.

All granulated products produced in Procedures (1) through (3) were mixed in a commercially available cross-rotary mixer for 10 minutes at room temperature. To the resulting mixture, 50.0 g of sodium N-myrystoil-alanine was added, and uniformly mixed for 3 minutes. The mixture was subjected to continuous tableting by the use of a rotary tableting machine (Clean Press Correct H18 produced by Kikusui Seisakusho) wherein the diameter was 20 mm, the thickness was 7 mm, a filling rate in one tablet was 3 g and tableting pressure was 4 t for producing a tablet for the solid processing agent for color developing replenishing solution for color paper. This is defined to be tablet J for color developing solution.

[Color developing solution]

For the initial solution of the color developing solution, the color developing solution of Example 1 is used. Replenisher water was fed at 46 ml per 1 $m^2$ of light-sensitive material. The tablet J was supplied at 1.19 tablets per 1 $m^2$ of light-sensitive material.

[Bleach-fixing step and stabilizing step]•[Processing condition]

These steps are identical to Example 1.

[Results]

Since the color developing solution was fed while the light-sensitive material was heated by means of heating drum 11 and heating drum 33, more rapid color developing reaction occurred and uneven development was negligible. Since the solid processing agent and the replenisher water were fed to processing solution container 21 in accordance with the processing amount of light-sensitive material P, volume inside processing solution container 21 can be reduced, and renewal ratio of the color developing solution can be increased so that deterioration of the color developing solution can be decreased.

Due to the synergetic effect thereof, extremely desirable processing can be conducted.

Example 5

Figure 8:
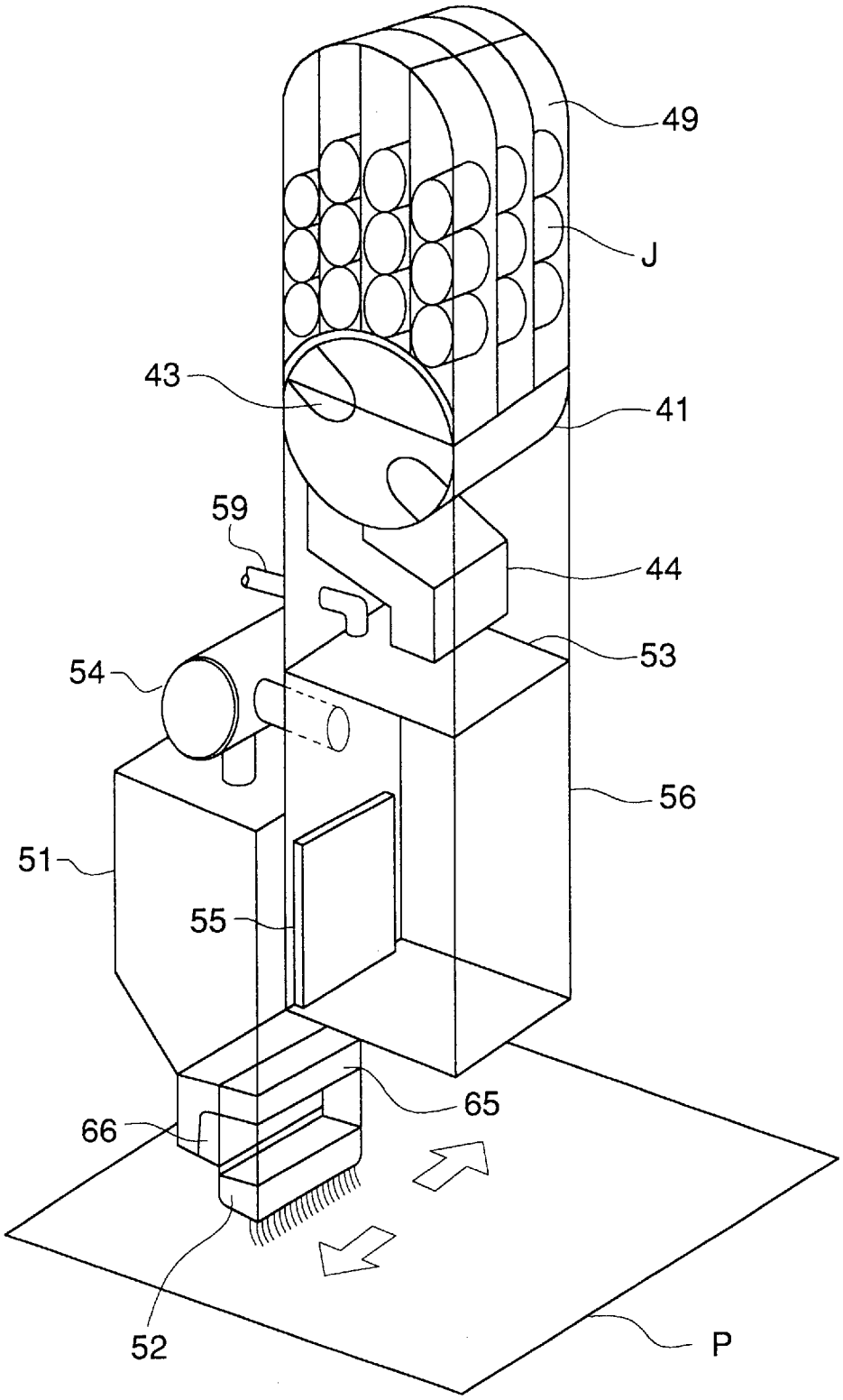
FIG. 8 is a perspective view of the main portion of an automatic processing machine of Example 5.

The present example modified developing means 50 in an automatic processing machine of Example 4. Hereinafter, those only modified point will be explained. FIG. 8 is a perspective view of the main portion of the automatic processing machine of Example 5.

[Apparatus]

Firstly, the width of processing solution feeding means is narrower (for example, 30 mm). The processing solution is fed over the entire width of light-sensitive material P by means of returning movement of the overall developing means 50 and solid processing agent supplying means 40 across the width direction of light-sensitive material P in accordance with the width of light-sensitive material P. Though there is no stirrer 57, due to the returning movement of the overall developing means 50 and solid processing agent supplying means 40 across the width direction of light-sensitive material P, the processing solution inside the processing solution container is stirred.

Secondly, a filter means (filter 55), provided between processing solution container 51 and processing solution feeding means 52, which filtrates the processing solution sent from processing solution container 91 is provided. In addition, the processing solution is not heated at the feeding port. However, heating means 66, which heats the processing solution, is provided between processing solution container 51 and processing solution feeding means 52. On processing solution feeding means 52, neither first shutter 62 nor second shutter 64 are provided.

Thirdly, replenisher water feeding means 59 feeds replenisher water by means of a flexible pipe.

Operational control unit 75 controls the width of the whole returning movement of developing means 50 and solid processing agent feeding means 40 in accordance with the width of sensed light-sensitive material P. When it determines that the width of light-sensitive material P is narrow (for example, 89 mm or less), it reduces the width of the whole returning movement of developing means 50 and solid processing agent feeding means 40 (for example, 90 mm). When it determines that the width of light-sensitive material P is middle (for example, 100 to 105 mm), it reduces/increases the width of the whole returning movement of developing means 50 and solid processing agent feeding means 40 to middle (for example, 105 mm). When it determines that the width of light-sensitive material P is wide (for example, 125 to 130 mm), it increases the width of the whole returning movement of developing means 50 and solid processing agent feeding means 40 (for example, 130 mm).

[Heating condition of the processing solution]

The processing solution after being processed was heated at 50° C. by means of heating means 66.

[Heating conditions]•[Second heating conditions]•[Processing condition]

These conditions are identical to Example 4.

[Feeding head]

It is identical to Example 4, except that the length of the head was 30 mm, and neither first shutter 62 nor second shutter were provided.

[Light-sensitive material]•[Preparation method of tablet J]•Color developing solution inside the processing solution container]•[Bleach-fixing step and stabilizing step]

They are identical to Example 4.

Example 6

Figure 9:
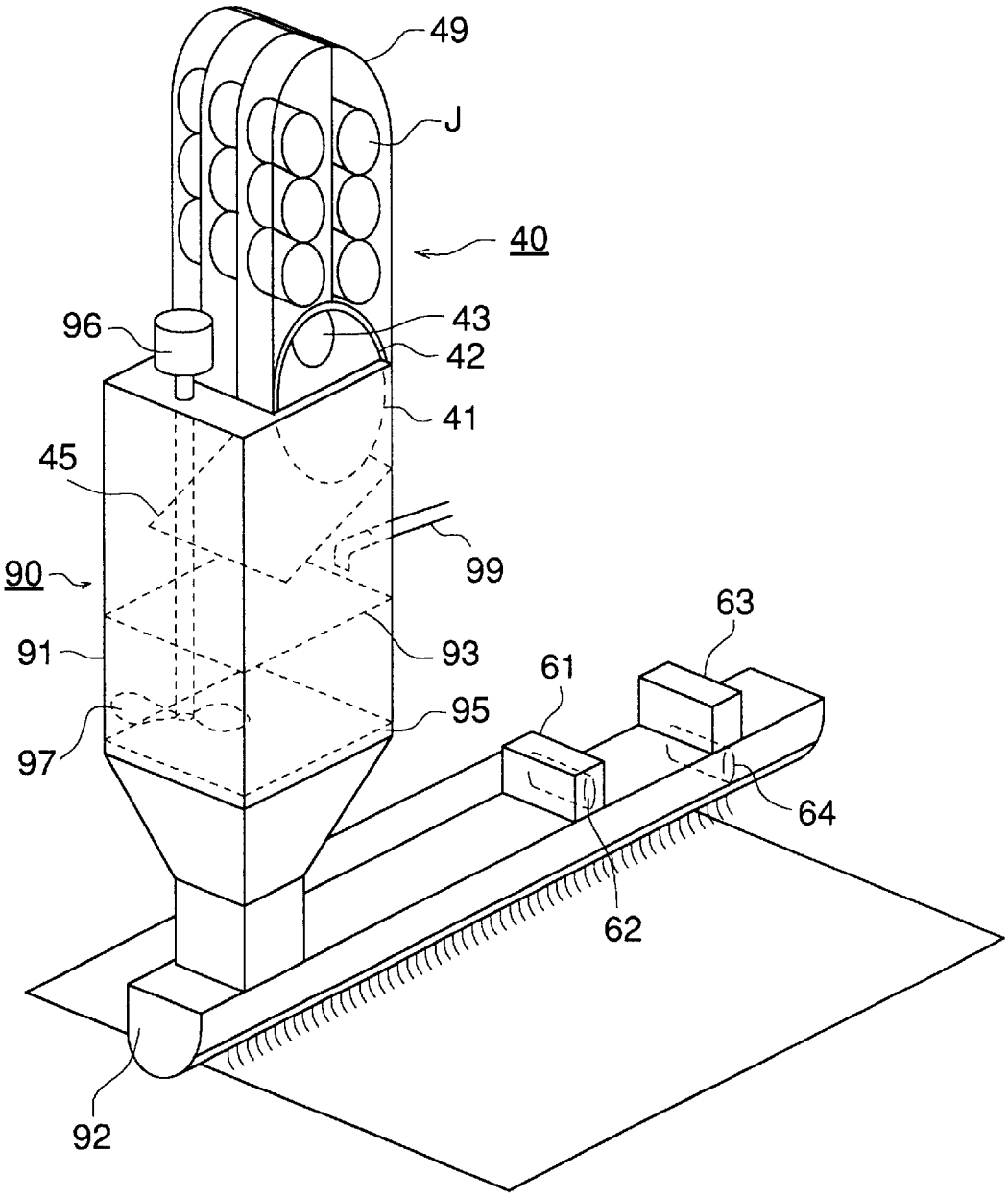
FIG. 9 is a perspective view of the main portion of an automatic processing machine of Example 6.

The present example modified developing means 50 in an automatic processing machine of Example 4 to a compact type. Hereinafter, those only modified issues will be explained. FIG. 9 is a perspective view of the main portion of the automatic processing machine of Example 6.

[Apparatus]

The apparatus has one processing solution container 91 as a processing solution container which houses a processing solution (color developing solution) processing light-sensitive material P. Processing solution container 91 is tightly closed against ambient air. As processing solution feeding means 92, a feeding head, described later, is used. Due to this, processing solution feeding means 92 feeds the color developing solution onto the emulsion surface of light-sensitive material P heated by means of heating means 10 through a gas phase. In addition, there is no circulation pump. Stirring propeller 97 which is rotated by means of motor 96 is rotated in processing solution container 91 for stirring the processing solution in processing solution container 91. In addition, there is provided a filter means (filter 95), provided between processing solution container 91 and processing solution feeding means 92, which filtrates the processing solution sent from processing solution container 91.

In addition, to processing solution container 91, replenisher water is fed from replenisher water feeding means 99. In addition, above processing solution surface 93 of processing solution container 91, solid processing agent supplying means 40 which supplies the solid processing agent for the silver halide photographic light-sensitive material is provided. Inside solid processing agent container 49 is divided into 6 compartments (3 lines×2 rows, plural rooms) by means of partitions so that, in each compartment, tablets can be housed substantially in point-contact or line-contact. Due to the above-mentioned structure, sticking of the solid processing agents each other can be prevented. Specifically, in the case of the present invention, the volume of the processing solution container can be reduced. For this purpose, the dimensions of the tablet must be reduced compared to conventional types. Therefore, sticking of the solid processing agents each other easily occurs. Accordingly, the above-mentioned structure is specifically useful. Inside quantitative supplying section 41, there is provided rotation rotor 42 is provided. Receiving cavities 43 are provided corresponding to each line of rooms in solid processing agent container 49 so that every time rotation rotor 42 is rotated by 120°, 2 tablets J are received by receiving cavities 43, and then, from receiving cavities 43 to introducing section 44, 2 tablets J are supplied each time. In the above-mentioned occasion, except when the solid processing agents are supplied, rotation rotor 42, except receiving cavities 43, faces introducing section 44. This mechanism prevents the entrance of moisture into solid processing agent container 49 side from the processing solution by means of the above-mentioned rotation rotor 42. Introducing section 45 is an inclined plate. Due to this structure, falling of the solid processing agent vigorously into processing solution surface 93 for splashing the solution is prevented.

On processing solution feeding means 92, first shutter 62 and second shutter 64 which stop the feeding of the processing solution to the feeding head at the middle of the width direction of light-sensitive material P. First shutter 62 is driven into the feeding path of the processing solution to the feeding head insertably/detachably by means of first shutter driving unit 61, and second shutter 62 is driven into the feeding path of the processing solution to the feeding head insertably/detachably by means of second shutter driving unit 63. FIG. 9 shows a state when second shutter 64 is inserted into the feeding path of the processing solution to the feeding head.

[Feeding head]

They are identical to Example 1.

[Apparatus control]•[Heating conditions]•[Second heating conditions]•[Light-sensitive material]•[Preparation method of tablet J]•[Color developing solution inside the processing solution container]•[Bleach-fixing step and stabilizing step]•[Processing condition]

They are identical to Example 4.

Example 7

[Apparatus]

Figure 10:
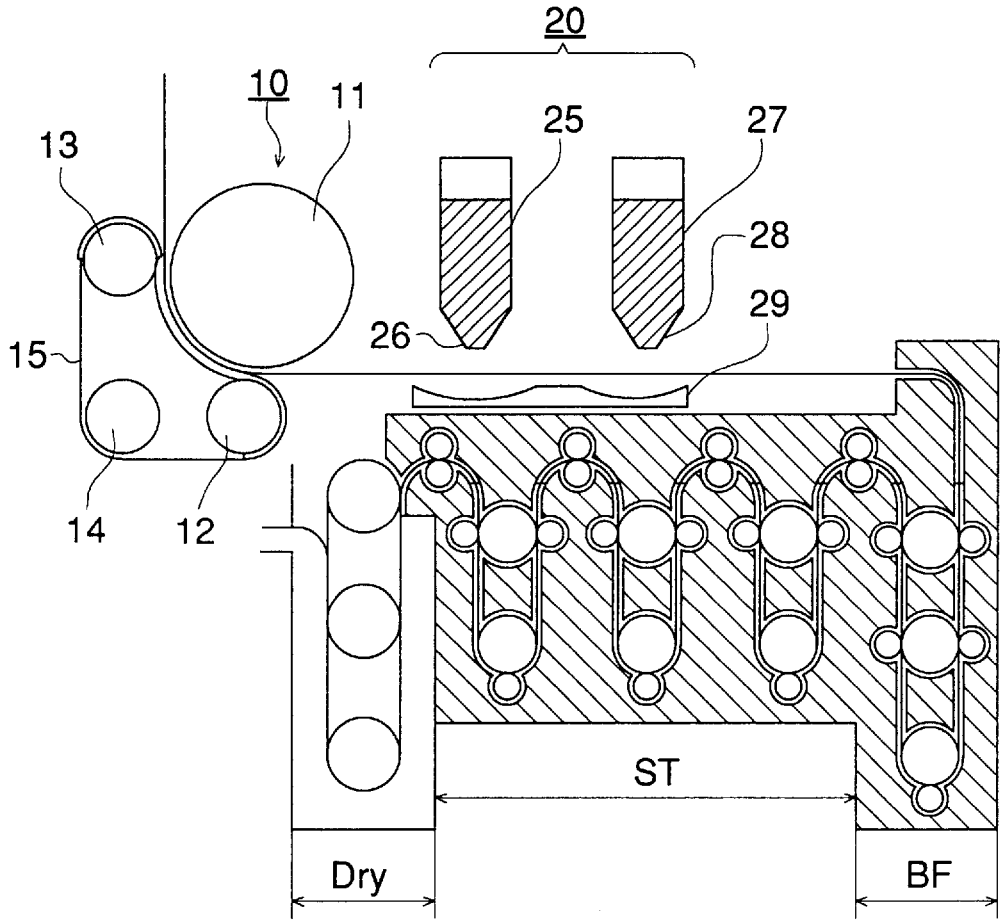
FIG. 10 is a schematic diagram of the main portion of an automatic processing machine of Example 7.

FIG. 10 is a schematic diagram of the main portion of an automatic processing machine of Example 7. On the upstream of a conveyance path of silver halide photographic light-sensitive material P, which is processed by the processing solution, heating means 10 which heats silver halide photographic light-sensitive material P is provided. Heating means 10 comprises heating drum 11 which heats light-sensitive material P from the emulsion side of the light-sensitive material P. Below heating drum 11, roller 12 at the exit area is provided. Left side of heating drum 11, roller 13 at the entry area is provided. Left side of roller 12 at the exit area and below roller 13 at the entry area, pressure belt driving roller 14 is provided. Pressure belt 15 is mounted on roller 12 at the exit area, roller 13 at the entry area and pressure belt driving roller 14. Due to a structure in which pressure belt 15 is driven over 90° of the circumference of heating drum 11 while it is pressed by heating drum 11, light-sensitive material P is pressed onto heating drum 11 to be conveyed. Due to the above-mentioned structure, light-sensitive material P is heated.

On the lowerstream of the conveyance path of light-sensitive material P from heating drum 11, developing means 20 is provided. As the processing solution container which houses the processing solution processing light-sensitive material P, developing means 20 has first processing solution container 25 which houses a low pH color developing agent solution for processing light-sensitive material P and second processing solution container 27 which houses a high pH color developing agent solution for processing light-sensitive material P. As first processing solution feeding means 26, which feeds the processing solution housed in first processing solution container 25 to light-sensitive material P and second processing solution feeding means 28, which feeds the processing solution housed in second processing solution container 27 to light-sensitive material P, the feeding head described later is used. Due to this, processing solution feeding means 52 feeds the color developing solution onto the emulsion surface of light-sensitive material P heated by means of heating means 10 through a gas phase. The processing solution overflowed from light-sensitive material P is drained to an effluent unit not illustrated by the use of tray 29.

Light-sensitive material P, subjected to color developing by means of developing means 20, is subjected to bleach-fixing in bleach-fixing solution tank BF, subjected to stabilizing in stabilizing solution tank ST, and then, dried in the drying unit.

[Heating conditions]•[Feeding head]

They are identical to Example 1.

[Light-sensitive material]

QA-A6 paper, produced by Konica Corporation, exposed to light by means of an ordinary method was processed.

[Processing solution formula in the first processing solution container]

Per 1 liter:

| | |
|---|---|
| Sodium sulfite | 1.0 g |
| Disodium bis(sulfoethyl)hydroxylamine | 12.0 g |
| CD-3 | 30.0 g |

By the use of potassium hydroxide or sulfuric acid, pH was regulated to 2 to 3.

[Processing solution formula in the second processing solution container]

Per 1 liter:

| | |
|---|---|
| Sodium sulfite | 0.05 g |
| Potassium carbonate | 100.0 g |
| Pentasodium diethylenetriaminepentaacetic acid | 3.0 g |
| Polyethylene gylcol #4000 | 10.0 g |
| Disodium bis(sulfoethyl)hydroxylamine | 12.0 g |
| Chinopal SFP | 2.0 g |
| Sodium p-toluenesulfonic acid | 20.0 g |
| Potassium hydroxide | 5.0 g |

By the use of potassium hydroxide or sulfuric acid, pH was regulated to 11.0.

[Bleach-fixing step and stabilizing step]

Under the processing conditions stipulated for the CPK-2-28 process by Konica Corporation, a light-sensitive material was processed by the use of processing solutions used in aforesaid process.

[Processing condition] is identical to Example 1.

[Results]

When 10 through 20 ml of the first processing solution and 10 through 20 ml of the second processing solution were fed per 1 $m^2$ of light-sensitive material P, preferable processing wherein processing progression is high can be conducted.

[Constitution 1]

Processing solution whose amount is only necessary to process the light-sensitive material may be fed. Therefore, reduction of processing progression can be prevented by heating the silver halide photographic light-sensitive material to which the processing solution is fed by means of the above-mentioned processing solution feeding means, while the amount of the photographic processing effluent can be reduced.

The light-sensitive material is heated before the processing solution is fed. Therefore, since the degree of the activity of the processing solution is high from the instant when the processing solution is fed to the light-sensitive material, the processing progression due to the processing solution is further increased.

The light-sensitive material is heated when the processing solution is fed. Therefore, while processing progression is being increased, temperature may (or may not) be controlled.

The light-sensitive material is heated when the processing solution is fed. Therefore, while processing progression is being increased, temperature may (or may not) be controlled.

The processing solution which was housed in the processing solution container is fed to the light-sensitive material. Therefore, by feeding the processing solution which processes the silver halide photographic light-sensitive material onto the emulsion surface of the silver halide photographic light-sensitive material through a gas phase, the amount of the processing solution inside the processing solution container can be decreased compared to cases where the light-sensitive material is immersed in the processing tank which houses the processing solution. Accordingly, the solution renewal ratio of the processing solution can be increased. In addition, since the amount of the processing solution only necessary to process the light-sensitive material may be fed, reduction of the processing progression can be prevented by heating the silver halide photographic light-sensitive material to which the processing solution is fed by means of the processing solution feeding means, while the amount of the photographic processing effluent can be reduced.

In addition, since the silver halide photographic light-sensitive material is heated, it is not necessary to heat the processing solution container for preventing the reduction of the processing progression. Therefore, it is not necessary to heat the processing solution container. Accordingly, deterioration of the processing solution housed in the processing solution container due to heat can be prevented.

[Constitution 2]

The processing solution whose amount is only necessary to process the light-sensitive material may be fed by feeding the processing solution which processes the silver halide photographic light-sensitive material onto the emulsion surface of the silver halide photographic light-sensitive material through a gas phase. Therefore, reduction of the processing progression can be prevented by heating the processing solution which is fed by means of the above-mentioned processing solution feeding means, while the amount of the photographic processing effluent can be reduced.

The processing solution fed from the processing solution container to the above-mentioned processing solution feeding means is heated so that the reduction of processing progression is prevented. When the processing tank which houses the processing solution is heated, it is difficult to heat the processing solution ordinarily to 45° C. or higher due to the storage stability of the processing solution. However, in the present invention, it is possible to heat the processing solution higher than the above-mentioned temperature. In such an occasion, it is possible to increase the processing progression, without worrying about the storage stability of the processing solution. In addition, it is not necessary to heat the processing solution container for preventing the reduction of processing progression, deterioration of the processing solution housed in the processing solution container due to heat can be prevented.

The processing solution is heated in the above-mentioned processing solution feeding means so that the reduction of processing progression can be prevented. When the processing tank which houses the processing solution is heated, it is difficult to heat the processing solution ordinarily to 45° C. or higher due to the storage stability of the processing solution. However, in the present invention, it is possible to heat the processing solution higher than the above-mentioned temperature. In such an occasion, it is possible to increase the processing progression, without worrying about the storage stability of the processing solution.

It is not necessary to heat the processing solution container for preventing the reduction of processing progression. Therefore, deterioration of the processing solution housed in the processing solution container due to heat can be prevented.

Replenishment can be conducted by supplying the solid processing agent and the replenishing water to the processing solution container which houses the processing solution processing the silver halide photographic light-sensitive material. Therefore, replenishment can be conducted more simply and more easily compared to a case when replacing the processing solution container. In addition, by supplying the solid processing agent and the replenishing water to the processing solution container which houses the processing solution processing the silver halide photographic light-sensitive material, the volume of the processing solution and the solution surface level of the processing solution can be included in a prescribed range. In such occasions, deterioration of the processing solution housed in the processing solution container can be prevented.

[Constitution 3]

Replenishment can be conducted by supplying the solid processing agent and the replenishing water to the processing solution container which houses the processing solution processing the silver halide photographic light-sensitive material. Therefore, replenishment can be conducted more simply and more easily compared to a case when replacing the processing solution container. In addition, by supplying the solid processing agent and the replenishing water to the processing solution container which houses the processing solution processing the silver halide photographic light-sensitive material, the volume of the processing solution and the solution surface level of the processing solution can be included in a prescribed range. In such occasions, deterioration of the processing solution housed in the processing solution container can be prevented.

Insoluble residues such as dust in the processing solution can be removed, and the occurrence of uneven processing, due to the clogging of the insoluble residues and supply of aforesaid clogging of the insoluble residues to the light-sensitive material, can be prevented. In addition, the corrosion of the processing solution feeding means due to the fact that the insoluble residues in the solid processing agent is clogged in the processing solution feeding means, rapidly deterioration of the processing solution inside the processing solution feeding means due to the fact that the density of the processing agent component inside the processing solution feeding means becomes abnormally increased when the feeding of the processing solution from the processing feeding means stops and the occurrence of discoloration and uneven processing due to the fact that the deteriorated processing solution is supplied to the light-sensitive material can be prevented.

Non-uniformity of the processing agent component and that of the density of the processing agent components can be prevented. In addition, dissolution of the solid processing agent is accelerated so that no problem occurs even when the processing amount of the light-sensitive material is large compared to the volume of the processing solution container. In addition, the above-mentioned filtration means can prevent splashing of undissolved solid processing agent in the processing solution to be stirred by the stirring means, and thereby, dissolution of the solid processing agent can be further accelerared.

Non-uniformity of the processing agent component and that of the density of the processing agent components can be prevented. In addition, dissolution of the solid processing agent is accelerated so that no problem occurs even when the processing amount of the light-sensitive material is large compared to the volume of the processing solution container. In addition, the above-mentioned filtration means can prevent splashing of undissolved solid processing agent in the processing solution to be stirred by the stirring means, and thereby, dissolution of the solid processing agent can be further accelerated.

Insoluble residues such as dust in the processing solution can be removed, and the occurrence of uneven processing, due to the clogging of the insoluble residues and supply of aforesaid clogging of the insoluble residues to the light-sensitive material, can be prevented. In addition, the corrosion of the processing solution feeding means due to the fact that the insoluble residues in the solid processing agent is clogged in the processing solution feeding means, rapidly deterioration of the processing solution inside the processing solution feeding means due to the fact that the density of the processing agent component inside the processing solution feeding means becomes abnormally increased when the feeding of the processing solution from the processing feeding means stops and the occurrence of discoloration and uneven processing due to the fact that the deteriorated processing solution is supplied to the light-sensitive material can be prevented.

Entry of fresh air into the processing solution in the processing solution container and deterioration of the processing solution due to the fresh air can be prevented. In addition, offensive odors and nausa due to it caused by the escape of gas which occurred due to the deterioration of the processing solution inside the processing solution container can be prevented.

Sufficient amount of the processing solution is fed to the light-sensitive material. Therefore, concurrently with that sufficient processability is resulted in, an excessive amount of the processing solution is not fed onto the light-sensitive material. Accordingly, overflow and dribbling of the fed processing solution from the emulsion surface of the light-sensitive material can easily be prevented.

The processing solution is either a developing solution or a bleaching solution. Therefore, since there is no processing step to remove silver ion and unnecessary materials from the light-sensitive material, it is easy to sufficiently process the light-sensitive material.

The processing solution is easily deteriorated due to air when the processing solution is a color developing solution. Therefore, effects to prevent the deterioration of the above-mentioned processing solution are more noticeable.

Drying of the processing solution at the feeding port is prevented. Therefore, uneven processing of the light-sensitive material which was processed by the processing solution located at the feeding port due to an increase of the density of the processing solution located at the feeding port by drying of the processing solution at the feeding port, deterioration of the processing solution located at the feeding port and clogging of the feeding port can be prevented.

Drying of the processing solution at the feeding port can be prevented with a simple mechanism, without providing an expensive mechanism such as a humidifier.

The processing solution can be fed only when necessary. Therefore, unnecessary feeding of the processing solution can be prevented.

With a simple apparatus, control, in which the above-mentioned processing solution feeding means feeds the processing solution only when the silver halide photographic light-sensitive material exists before the processing solution feeding means feeds the processing solution, can be conducted. Due to this, the processing solution can be fed only when necessary. Therefore, wasted supply of the processing solution can be prevented. In addition, contamination of associated devices due to wasted supply of the processing solution can be prevented.

With a simple apparatus, control, in which the above-mentioned processing solution feeding means feeds the processing solution only when the silver halide photographic light-sensitive material exists before the processing solution feeding means feeds the processing solution, can be conducted. Due to this, the processing solution can be fed only when necessary. Therefore, wasted supply of the processing solution can be prevented. In addition, contamination of associated devices due to wasted supply of the processing solution can be prevented.

The processing solution can be fed for necessary width in accordance with the width of the light-sensitive material. Therefore, wasted supply of the processing solution can be prevented. In addition, contamination of associated devices due to wasted supply of the processing solution can be prevented.

Clogging due to drying of the processing solution in the processing solution feeding means can be prevented. In addition, uneven processing and discoloration on a processed light-sensitive material by the deterioration of processing solution in the processing solution feeding means can be prevented.

What is claimed is:

1. An apparatus for processing a silver halide photographic light-sensitive material having an emulsion surface, comprising:

a silver halide color photographic light-sensitive material used as the silver halide photographic light-sensitive material, the silver halide color photographic light-sensitive material having an emulsion surface including a blue sensitive layer, a green sensitive layer and a red sensitive layer with which a color image is formed;

conveying means for conveying the light-sensitive material in a predetermined direction;

a heater for heating the light sensitive material, wherein the heater heats the light sensitive material so that a temperature of the emulsion surface including the blue sensitive layer, the green sensitive layer and the red sensitive layer is raised to 40° C. to 100° C.; and a supplier having a supplying section positioned so as to form air space between the supplying section and the emulsion surface of the conveyed light-sensitive material so that the supplier supplies a processing solution from the supplying section through the air space onto the emulsion surface of the conveyed light-sensitive material, wherein the processing solution is a developing solution and the supplier supplies the developing solution in an amount of 20 ml to 200 ml per 1 $m^2$ of the light-sensitive material.

2. The apparatus of claim 1, wherein the heater and the supplier are arranged in such a way in terms of the conveying direction that the supplier supplies the processing solution onto the emulsion surface which has been heated by the heater.

3. The apparatus of claim 1, wherein the heater and the supplier are arranged in such a way in terms of the conveying direction that the supplier supplies the processing solution onto the emulsion surface which is being heated by the heater.

4. The apparatus of claim 1, wherein the heater and the supplier are arranged in such a way in terms of the conveying direction that the heater heats the emulsion surface which has been supplied with the processing solution.

5. The apparatus of claim 1, wherein the temperature is 45° C. to 90° C.

6. The apparatus of claim 5, wherein the temperature is 50° C. to 80° C.

7. An apparatus for processing a silver halide photographic light-sensitive material having an emulsion surface, comprising:

conveying means for conveying the light-sensitive material in a predetermined direction;

a heater for heating the light sensitive material; and a supplier having a supplying section positioned so as to form air space between the supplying section and the emulsion surface of the conveyed light-sensitive material so that the supplier supplies a processing solution from the supplying section through the air space onto the emulsion surface of the conveyed light-sensitive material, wherein the supplier comprises a container in which the processing solution is stored, an agent replenisher for supplying a solid processing agent into the container and a water replenisher for supplying water into the container.

8. An apparatus for processing a silver halide photographic light-sensitive material having an emulsion surface, comprising:

conveying means for conveying the light-sensitive material in a predetermined direction;

a heater for heating the light sensitive material; and a supplier having a supplying section positioned so as to form air space between the supplying section and the emulsion surface of the conveyed light-sensitive material so that the supplier supplies a processing solution from the supplying section through the air space onto the emulsion surface of the conveyed light-sensitive material, wherein the supplying section has a supply hole through which the processing solution is supplied, and the supplier comprises a prevention member for preventing the supply hole from becoming dry.

9. The apparatus of claim 8, wherein the supplier comprises a detector to detect the presence of the light-sensitive material and wherein the prevention member is a cover member and the cover member shelters the supply hole when the detector does not detect the presence of the light-sensitive material.

10. The apparatus of claim 8, wherein the supplying section is a jetting head having a plurality of jetting holes whose area is $1\times10^{-11}$ $m^2$ to $1\times10^{-8}$ $m^2$.

11. The apparatus of claim 10, wherein the jetting head jets the processing solution 1 time/sec to $1\times10^{6}$ times/sec.

12. The apparatus of claim 10, wherein each of the plurality of jetting holes is distant from others with a distance of $5\times10^{-6}$ m to $1\times10^{-3}$ m.

13. The apparatus of claim 10, wherein the distance between the emulsion surface of the light-sensitive material and each of the plurality of jetting holes is 50 $\mu$m to 5 mm.

* * * * *